US008669028B2

(12) United States Patent
Kawabata et al.

(10) Patent No.: US 8,669,028 B2
(45) Date of Patent: Mar. 11, 2014

(54) ELECTROPHOTOGRAPHIC PHOTORECEPTOR, METHOD FOR PRODUCING ELECTROPHOTOGRAPHIC PHOTORECEPTOR, IMAGE FORMING APPARATUS, AND PROCESS CARTRIDGE

(75) Inventors: Yukimi Kawabata, Kanagawa (JP); Yuko Yamano, Kanagawa (JP); Kazuyuki Tada, Kanagawa (JP); Kenji Ikeda, Kanagawa (JP); Mitsuhide Nakamura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 168 days.

(21) Appl. No.: 13/052,405

(22) Filed: Mar. 21, 2011

(65) Prior Publication Data

US 2012/0064442 A1 Mar. 15, 2012

(30) Foreign Application Priority Data

Sep. 10, 2010 (JP) ..... 2010-203305

(51) Int. Cl.
*G03G 5/147* (2006.01)

(52) U.S. Cl.
USPC ... 430/58.7; 430/58.05; 430/58.3; 430/58.65; 430/58.75; 430/59.6; 430/66

(58) Field of Classification Search
USPC ..... 430/58, 58.75, 66, 58.05, 58.3, 58.35, 430/58.65, 58.7, 59.6
See application file for complete search history.

(56) References Cited

U.S. PATENT DOCUMENTS 5,283,145 A 2/1994 Nukada et al.
5,290,928 A 3/1994 Nukada et al.
5,298,617 A 3/1994 Nukada et al.
5,302,479 A 4/1994 Daimon et al.
5,308,728 A 5/1994 Imai et al.
5,338,636 A 8/1994 Nukada et al.

(Continued)

FOREIGN PATENT DOCUMENTS

JP A-4-189873 7/1992
JP A-4-324451 11/1992

(Continued)

OTHER PUBLICATIONS

Chemical Society of Japan; Jikken Kagaku Kohza (Experimental Chemical Lecture); May 6, 1992; pp. 430-431; 4th edition; vol. 28; published by Kumao Ebihara (with translation).

*Primary Examiner* — Christopher Rodee
*Assistant Examiner* — Omar Kekia
(74) *Attorney, Agent, or Firm* — Oliff PLC

(57) ABSTRACT

An electrophotographic photoreceptor is provided, which includes: a substrate; a photosensitive layer; and a surface protective layer, in this order, in which the protective layer contains a crosslinked product of a curable charge transporting material in a content of from about 90 to 98% by weight, and fluorinated resin particles in a content of from about 2 to 10% by weight, and the protective layer satisfies Formula (1): $0.5 \leq b/a \leq 1$, wherein, "a" represents a ratio of fluorine atoms to the sum of carbon atoms, oxygen atoms, and fluorine atoms present in a region of the protective layer ranging from the photosensitive layer side surface thereof to a point corresponding to about ⅔ of the thickness thereof, and "b" represents the ratio in a region of the protective layer ranging from the outer surface thereof to a point corresponding to about ⅓ of the thickness thereof.

8 Claims, 3 Drawing Sheets

(56) References Cited

U.S. PATENT DOCUMENTS

| | | | | |
|---|---|---|---|---|
| 5,358,813 | A | 10/1994 | Iijima et al. | |
| 5,378,569 | A | 1/1995 | Nukada et al. | |
| 5,393,629 | A | 2/1995 | Nukada et al. | |
| 5,416,207 | A | 5/1995 | Imai et al. | |
| 5,459,004 | A | 10/1995 | Daimon et al. | |
| 5,463,043 | A | 10/1995 | Nukada et al. | |
| 5,639,581 | A | 6/1997 | Iwasaki et al. | |
| 5,654,119 | A | 8/1997 | Ishii et al. | |
| 5,734,003 | A | 3/1998 | Iwasaki et al. | |
| 6,913,862 | B2 * | 7/2005 | Nakata et al. | 430/58.1 |
| 6,933,090 | B2 * | 8/2005 | Inagaki et al. | 430/59.6 |
| 2009/0004583 | A1 * | 1/2009 | Nukada et al. | 430/58.5 |
| 2011/0318677 | A1 * | 12/2011 | Doi et al. | 430/56 |

FOREIGN PATENT DOCUMENTS

| | | |
|---|---|---|
| JP | A-5-43813 | 2/1993 |
| JP | A-5-98181 | 4/1993 |
| JP | A-5-140472 | 6/1993 |
| JP | A-5-140473 | 6/1993 |
| JP | A-5-263007 | 10/1993 |
| JP | A-5-279591 | 10/1993 |
| JP | A-8-176293 | 7/1996 |
| JP | A-8-208820 | 8/1996 |
| JP | A-2008-46197 | 2/2008 |
| JP | A-2009-145480 | 7/2009 |

* cited by examiner

ELECTROPHOTOGRAPHIC PHOTORECEPTOR, METHOD FOR PRODUCING ELECTROPHOTOGRAPHIC PHOTORECEPTOR, IMAGE FORMING APPARATUS, AND PROCESS CARTRIDGE

CROSS-REFERENCE TO RELATED APPLICATION

This application claims priority under 35 USC 119 from Japanese Patent Application No. 2010-203305 filed on Sep. 10, 2010.

BACKGROUND

1. Technical Field

The present invention relates to an electrophotographic photoreceptor, a method for producing the electrophotographic photoreceptor, an image forming apparatus, and a process cartridge.

2. Related Art

Recently, efforts have been made to improve the speed, increase the image quality, and extend the life of xerographic image forming apparatuses, which have a charging unit, an exposure unit, a development unit, a transfer unit, and a fixing unit, by technical developments in the respective members and systems.

SUMMARY

According to a first aspect of the invention, there is provided an electrophotographic photoreceptor including:

a substrate, a photosensitive layer, and a surface protective layer, in this order, the surface protective layer including a crosslinked product of a curable charge transporting material and fluorinated resin particles, a content of the charge transporting material being from about 90% by weight to about 98% by weight and a content of the fluorinated resin particles being from about 2% by weight to about 10% by weight, and the surface protective layer satisfying the following Formula (1):

$$0.5 \leq b/a \leq 1 \qquad \text{Formula (1)}$$

wherein, in Formula (1), "a" represents a ratio of fluorine atoms to the sum of carbon atoms, oxygen atoms, and fluorine atoms present in a region of the surface protective layer ranging from the photosensitive layer side surface of the surface protective layer to a point corresponding to about ⅔ of the film thickness of the surface protective layer, and "b" represents a ratio of fluorine atoms to the sum of carbon atoms, oxygen atoms, and fluorine atoms present in a region of the surface protective layer ranging from the outer surface of the surface protective layer to a point corresponding to about ⅓ of the film thickness of the surface protective layer.

BRIEF DESCRIPTION OF THE DRAWINGS

Exemplary embodiments of the present invention will be described in detail based on the following figures, wherein.

DETAILED DESCRIPTION

Figure 1:
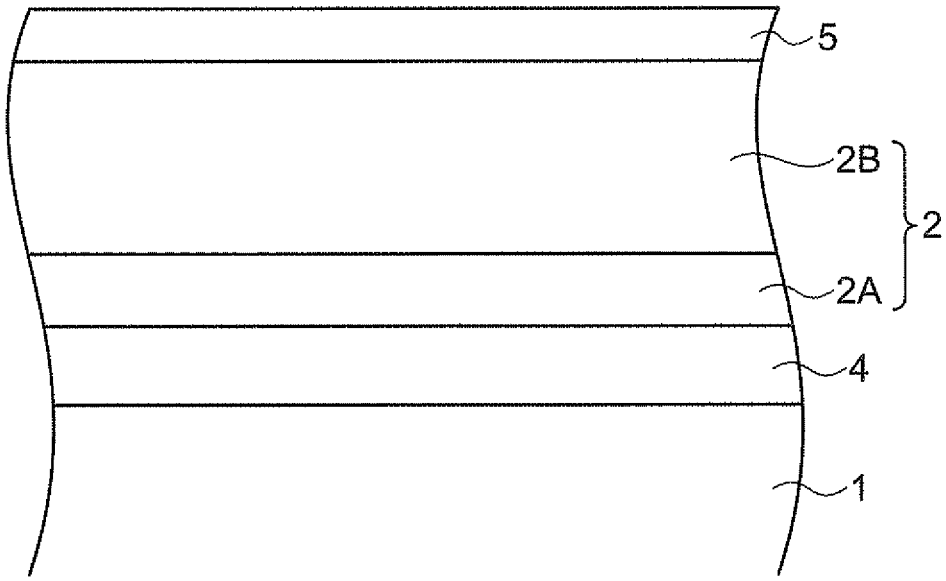
FIG. 1 is a schematic partial cross-sectional view showing an electrophotographic photoreceptor according to a first aspect of the present invention.

Hereinbelow, exemplary embodiments of the present invention will be described in detail.

Electrophotographic Photoreceptor

An electrophotographic photoreceptor according to an exemplary embodiment of the present invention (which may be simply referred to as a "photoreceptor" in some cases) includes at least: a substrate; a photosensitive layer; and a surface protective layer, in this order, in which the surface protective layer contains at least a crosslinked product of a curable charge transporting material and fluorinated resin particles, a content of the charge transporting material is from 90% by weight to 98% by weight (or from about 90% by weight to about 98% by weight) and a content of the fluorinated resin particles is from 2% by weight to 10% by weight (or from about 2% by weight to about 10% by weight), and the following Formula (1) is satisfied.

$$0.5 \leq b/a \leq 1 \qquad \text{Formula (1)}$$

In Formula (1), "a" represents a ratio of fluorine atoms to the sum of carbon atoms, oxygen atoms, and fluorine atoms present in a region of the surface protective layer ranging from the photosensitive layer side surface of the surface protective layer to a point corresponding to ⅔ (or about ⅔) of the film thickness of the surface protective layer, and "b" represents a ratio of fluorine atoms to the sum of carbon atoms, oxygen atoms, and fluorine atoms present in a region of the surface protective layer ranging from the outer surface of the surface protective layer to a point corresponding to ⅓ (or about ⅓) of the film thickness of the surface protective layer.

As used herein, the term "photosensitive layer side surface of the surface protective layer" refers to, among the surfaces of the surface protective layer, a surface of the surface protective layer which faces or is close to the photosensitive layer. Furthermore, as used herein, the term "outer surface of the surface protective layer" refers to, among the surfaces of the surface protective layer, a surface thereof which is further from the photosensitive layer, i.e., a surface of the surface protective layer that is opposite to the photosensitive layer side surface. For example, in a case in which a photosensitive layer and a surface protective layer in this order are superimposed on a substrate, the "photosensitive layer side surface of the surface protective layer" refers to a lower surface of the surface protective layer, and the "outer surface of the surface protective layer" refers to an upper surface of the surface protective layer.

In general, fluorinated resin particles have large specific gravity. Therefore, particularly, when the content of the fluorinated resin particles in the surface protective layer of the photoreceptor is 10% by weight or less, the content of the fluorinated resin particles at the outer surface of the surface protective layer becomes relatively low due to convection flow caused by the surface tension gradients and the differences in temperatures during drying. That is, it is not easy to make the fluorinated resin particles exist uniformly in the surface protective layer. When the content of the fluorinated resin particles at the outer surface of the surface protective layer is small, the proportion of the fluorinated resin particles existing at the surface of a photoreceptor changes as the photoreceptor is abraded, leading to changes in the cleaning property and transfer efficiency.

In this regard, the photoreceptor according to the exemplary embodiment of the present invention has a value of "b/a" controlled to fall within the range of from 0.5 to 1, that is, the unevenness of the contents of the fluorinated resin particles in the surface protective layer is relatively more suppressed. As a result, it is presumed that the changes in the cleaning property and the transfer efficiency, which are caused by abrasion of the photoreceptor, are suppressed.

When a coating liquid for forming the surface protective layer is produced, it is preferable to adsorb a surfactant on the fluorinated resin particle surfaces to disperse the fluorinated resin particles in the coating liquid. However, when a surfactant does not adsorb to the fluorinated resin particles and thus is liberated from the fluorinated resin particles, it bleeds out onto the surface of the surface protective layer, and thus, when the surfactant is used in an image forming apparatus, it may be a cause for light-induced fatigue, image flow, or the like in the photoreceptor in some cases.

In this regard, the photoreceptor according to the exemplary embodiment of the invention, in which the value of "b/a" is controlled to be 1 or less has a smaller proportion of the fluorinated resin particles at the outer surface of the surface protective layer, as compared to when the value of "b/a" is more than 1. Accordingly, the abrasion rate at the outer surface of the surface protective layer tends to be relatively large. Therefore, it is presumed that the surfactant bleeding out on the surface is removed by abrasion, whereby the light-induced fatigue, image flow, or the like is suppressed.

It is more preferable that the numeral value of "b/a" satisfies $0.7 \leq b/a \leq 1$, and particularly preferably satisfies $0.9 \leq b/a \leq 1$.

Method for Calculation of b/a

Herein, the ratio of the fluorine atoms to the sum of the carbon atoms, oxygen atoms, and fluorine atoms is calculated by energy dispersive X-ray spectroscopy (EDS). Specifically, a surface protective layer and underlying layer(s) thereof are peeled off from a photoreceptor, and a small piece thereof is taken out, embedded in an epoxy resin, and solidified. A section thereof is prepared using a microtome, and used as a sample for measurement. Using JSM-6700F/JED-2300F (trade name, manufactured by JEOL Ltd.) as an EDS apparatus, the ratios of the fluorine atoms to the sum of the carbon atoms, oxygen atoms, and fluorine atoms present in a region of the surface protective layer ranging from the photosensitive layer side surface of the surface protective layer to a point corresponding to ⅔ of the film thickness of the surface protective layer are measured at intervals of 5 μm, and the average ratio thereof is taken as "a". Furthermore, the ratios of the fluorine atoms to the sum of the carbon atoms, oxygen atoms, and fluorine atoms present in a region of the surface protective layer ranging from the outer surface of the surface protective layer to a point corresponding to ⅓ of the film thickness of the surface protective layer are measured at intervals of 5 μM, and the average ratio thereof is taken as "b". Then, "b/a" is calculated using the obtained values of "a" and "b".

Method for Controlling b/a

When the surface protective layer is a cured film obtained by curing a curable charge transporting material, it is preferable to form the surface protective layer by an ink jet method including the processes (i) to (iii) below, from the viewpoints of controlling the value "b/a" to fall within the above-described ranges.

When the surface protective layer is a cured film obtained by thermosetting a compound having a guanamine structure or a melamine structure with a charge transporting material having at least one substituent selected from the group consisting of —OH, —$OCH_3$, —$NH_2$, —SH, and —COOH using an acid catalyst, it is preferable to form the surface protective layer by an inkjet method including the steps (i) to (iii) below.

(i) Coating Liquid Preparation Process

First, a coating liquid satisfying the conditions described below is prepared.

The coating liquid contains a crosslinked product of a curable charge transporting material and fluorinated resin particles.

The coating liquid has a viscosity of from 10 mPa·s to 60 mPa·s (or from about 10 mPa·s to about 60 mPa·s), preferably from 20 mPa·s to 60 mPa·s (or from about 20 mPa·s to about 60 mPa·s), and particularly preferably from 30 mPa·s to 60 mPa·s (or from about 30 mPa·s to about 60 mPa·s).

The content of the charge transporting material after drying is from 90% by weight to 98% by weight (or from about 90% by weight to about 98% by weight).

The content of the fluorinated resin particles after drying is from 2% by weight to 10% by weight (or from about 2% by weight to about 10% by weight).

(ii) Coating Liquid Ejection Process

The coating liquid is jetted by ink jetting in the form of liquid droplets having a size (or volume) of from 1 pl to 20 pl (or from about 1 pl to about 20 pl) onto a photosensitive layer on a substrate having thereon at least the photosensitive layer from a liquid droplet ejection head, to thereby form a coating film. The size of the liquid droplet is particularly preferably from 1 pl to 10 pl (or from about 1 pl to about 10 pl).

(iii) Drying Process

The coating film is dried by heating to form a surface protective layer.

The viscosity is determined by measuring at a liquid temperature of 24° C. using a B type viscometer (trade name, manufactured by Toyo Keiki Co., Ltd.).

The liquid droplets jetted from an inkjet liquid droplet ejection head reach a substrate (e.g., the surface of a photosensitive layer) while increasing the solid concentration during flying, and thus, the viscosity of the liquid droplet is increased. In this regard, by reducing the amounts of liquid droplets, that is, as described above, by adjusting the amounts to from 1 pl to 20 pl, the scattering (or diffusion) of the solvent during flying is promoted, and the convection during drying of the surface protective layer is suppressed. As a result, the unevenness of the fluorinated resin particles in the surface protective layer is suppressed, and the value "b/a" is adjusted to fall within the above-described ranges.

The method for controlling the value "b/a" to fall within the above-described ranges is not limited to the inkjet method. For example, when a surface protective layer is formed using an acryl resin as a resin, the value may be controlled by the following method including processes (I) to (III).

(I) Coating Liquid Preparation Process

First, a coating liquid satisfying the conditions described below is prepared.

The coating liquid contains an acryl-modified monomer that is one of polymerizable monomers, a thermo- or photopolymerization initiator, and fluorinated resin particles.

The content of the charge transporting material after drying is from 75% by weight to 98% by weight.

The content of the fluorinated resin particles after drying is from 2% by weight to 25% by weight.

(II) Coating Process

The coating liquid is applied onto a photosensitive layer on a substrate having thereon at least the photosensitive layer by an immersion method, to thereby form a coating film.

(III) Drying Process

The coating film is subjected to vacuum deaeration, and then dried by heating, to thereby form a surface protective layer.

Next, the configuration of a photoreceptor according to an exemplary embodiment of the invention will be described.

Configuration of Photoreceptor

The photoreceptor according to an exemplary embodiment of the invention has at least: a substrate; a photosensitive layer; and a surface protective layer, in this order, in which the surface protective layer includes at least a crosslinked product of a compound including a curable charge transporting material, and fluorinated resin particles, the content of the charge transporting material is from 90% by weight to 98% by weight, and the content of the fluorinated resin particles is from 2% by weight to 10% by weight.

The surface protective layer is preferably a cured film (or a crosslinked film) obtained by thermosetting a compound having a guanamine structure or a melamine structure with a charge transporting material having at least one substituent selected from the group consisting of —OH, —$OCH_3$, —$NH_2$, —SH, and —COOH, using an acid catalyst.

Herein, the photosensitive layer according to an exemplary embodiment of the invention may be a single-layer multi-functional photosensitive layer having both a charge transporting ability and a charge generating ability, or may be a multi-layered photosensitive layer including plural sub-layers having different functions, including a charge transporting layer and a charge generating layer. Furthermore, in exemplary embodiments, the photoreceptor may have other layers such as an undercoat layer.

Hereinbelow, the configurations of the photoreceptor according to exemplary embodiments of the present invention will be described with reference to FIGS. 1 and 2, but the present invention is not intended to be limited to FIGS. 1 and 2.

FIG. 1 is a schematic sectional view showing an example of the layer configuration of a photoreceptor according to an exemplary embodiment of the invention. The photoreceptor shown in FIG. 1 has a substrate 1, a photosensitive layer 2 including a charge generating layer 2A and a charge transporting layer 2B, an undercoat layer 4, and a protective layer 5.

The photoreceptor shown in FIG. 1 has a layer configuration in which an undercoat layer 4, a charge generating layer 2A, a charge transporting layer 2B, and a protective layer 5 are deposited in this order on a substrate 1, and two layers of the charge generating layer 2A and the charge transporting layer 2B together forms a photosensitive layer 2 (first exemplary embodiment).

In the photoreceptor shown in FIG. 1, the protective layer 5 is the surface protective layer.

Figure 2:
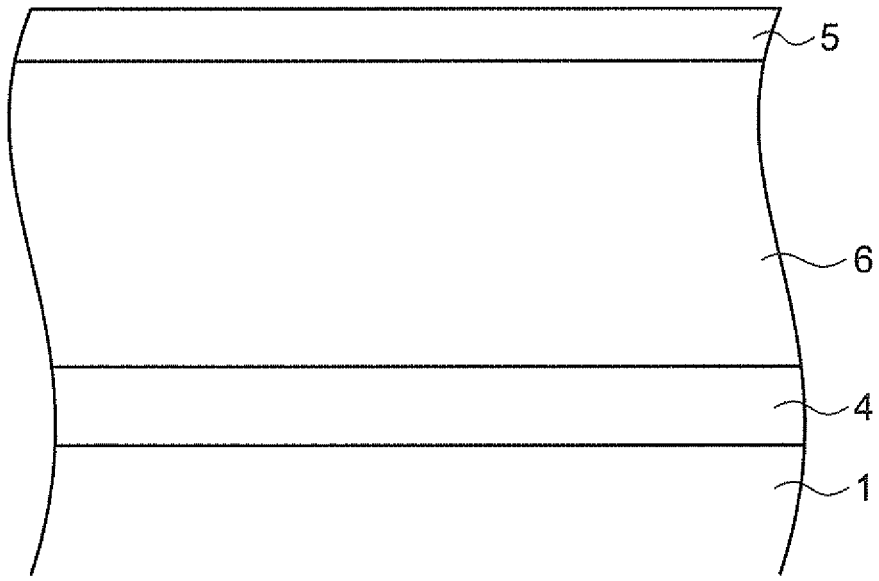
FIG. 2 is a schematic partial cross-sectional view showing an electrophotographic photoreceptor according to a second aspect of the present invention.

FIG. 2 is a schematic sectional view showing an example of the layer configuration of a photoreceptor according to another embodiment of the invention. In FIG. 2, the photoreceptor has a single-layered multi-functional photosensitive layer, and other constitutional components thereof are substantially the same as those of the photoreceptor shown in FIG. 1.

The photoreceptor shown in FIG. 2 has a layer configuration in which an undercoat layer 4, a photosensitive layer 6, and a protective layer 5 are disposed in this order on a substrate 1, and the photosensitive layer 6 is a layer integrally having functions of the charge generating layer 2A and the charge transporting layer 2B shown in FIG. 1 (second exemplary embodiment).

In the photoreceptor shown in FIG. 2, the protective layer 5 is the surface protective layer.

Hereinbelow, the photoreceptor of the present invention will be described in detail by way of example of the first exemplary embodiment.

First Exemplary Embodiment

The photoreceptor according to the first exemplary embodiment of the invention has a layer configuration in which, as shown in FIG. 1, an undercoat layer 4, a charge generating layer 2A, a charge transporting layer 2B, and a protective layer 5 are disposed in this order on a substrate 1, and the protective layer 5 is the surface protective layer.

Substrate

As the substrate 1, a substrate having conductive property is used. Examples thereof include metal plates, metal drums, and metal belts formed using metals such as aluminum, copper, zinc, stainless steel, chromium, nickel, molybdenum, vanadium, indium, gold, or platinum, or alloys thereof; and paper sheets, plastic films, and belts which are coated, deposited, or laminated with an electroconductive compound such as an electroconductive polymer or indium oxide, a metal such as aluminum, palladium, or gold, or an alloy thereof. Herein, the expression "having conductive property" or the like means that the volume resistivity is less than $10^{13}$ Ωcm.

When the photoreceptor according to the first exemplary embodiment is used in a laser printer, the surface of the substrate 1 is preferably roughened so as to have a centerline average roughness Ra of from 0.04 μm to 0.5 μm. However, when an incoherent light is used as a light source, there is no particular need for surface roughening.

Examples of the method for surface roughening include wet honing in which an abrasive agent suspended in water is blown onto a support, centerless grinding in which a support is continuously ground by pressing the support into contact with a rotating grind stone, and anodic oxidation.

Another example of the method for surface roughening is a method for surface roughening including dispersing electroconductive or semiconductive particles in a resin, and forming a layer of the resin on the support surface, so that the surface roughening is achieved by the particles dispersed in the resin layer, instead of roughening the surface itself of the substrate 1.

Herein, in the surface-roughening treatment by anodic oxidation, an oxide film is formed on an aluminum surface by anodic oxidation using an aluminum anode in an electrolyte solution. Examples of the electrolyte solution include a sulfuric acid solution, and an oxalic acid solution. However, since the porous anodic oxide film formed by anodic oxidation without modification is chemically active, a sealing treatment may be conducted, in which fine pores of the anodic oxide film are sealed by cubical expansion caused by hydration in pressurized water vapor or boiled water (to which a salt of a metal such as nickel may be added) to transform the anodic oxide into a more stable hydrated oxide. The thickness of the anodic oxide film may be from 0.3 μm to 15 μm.

The substrate 1 may be subjected to a treatment with an acidic aqueous solution or a boehmite treatment.

A treatment with an acidic treatment liquid including phosphoric acid, chromic acid, and hydrofluoric acid is carried out as follows. First, an acidic treatment liquid is prepared. The mixing ratio of phosphoric acid, chromic acid, and hydrofluoric acid in the acidic treatment liquid is preferably in the range from 10% by weight to 11% by weight of phosphoric acid, from 3% by weight to 5% by weight of chromic acid, and from 0.5% by weight to 2% by weight of hydrofluoric acid, based on the total weight of the acidic treatment liquid. The concentration of the total acid components may be in the range from 13.5% by weight to 18% by weight. The treatment temperature may be from 42° C. to 48° C. The thickness of the coated film may be from 0.3 μm to 15 μm.

The boehmite treatment is carried out by immersing the substrate in pure water at a temperature from 90° C. to 100° C. for 5 minutes to 60 minutes, or by bringing it into contact with heated water vapor at a temperature from 90° C. to 120° C. for 5 minutes to 60 minutes. The thickness of the coated film may be from 0.1 μm to 5 μm. The film may further be subjected to anodic oxidation using an electrolyte solution containing an electrolyte having relatively low film-dissolving property, such as adipic acid, boric acid, a borate salt, a phosphate, a phthalate, a maleate, a benzoate, a tartarate, or a citrate.

Undercoat Layer

The undercoat layer 4 is formed as, for example, a layer of a binder resin containing inorganic particles.

As the inorganic particles, inorganic particles having a powder resistance (volume resistivity) of from $10^2$ Ω·cm to $10^{11}$ Ω·cm may be used.

Examples of the inorganic particles having the resistance value mentioned above include inorganic particles of tin oxide, titanium oxide, zinc oxide, zirconium oxide, and the like (i.e., conductive metal oxides), and zinc oxide is particularly preferably used.

The inorganic particles may be those which have been subjected to a surface treatment. Inorganic particles which have been subjected to different surface treatments or which have different particle diameters may be used in combination of two or more kinds thereof. The volume average particle diameter of the inorganic particles is preferably in the range from 50 nm to 2,000 nm, and more preferably from 60 nm to 1,000 nm.

The inorganic particles preferably has a specific surface area, as measured by means of a BET method, of 10 $m^2/g$ or more are preferably used.

In addition to the inorganic particles, the undercoat layer may include a compound having an acceptor property (i.e., an acceptor compound). Any compound having an acceptor property may be used as the acceptor compound. Examples thereof include electron transporting materials such as: quinone compounds such as chloranil or bromoanil; tetracyanoquinodimethane compounds; fluorenone compounds such as 2,4,7-trinitrofluorenone or 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole, or 2,5-bis(4-diethylaminophenyl)-1,3,4-oxadiazole; xanthone compounds; thiophene compounds; and diphenoquinone compounds such as 3,3',5,5'-tetra-t-butyldiphenoquinone, and compounds having an anthraquinone structure are particularly preferable. Furthermore, acceptor compounds having an anthraquinone structure, such as a hydroxyanthraquinone compound, an aminoanthraquinone compound, or an aminohydroxyanthraquinone compound are preferably used, and specific examples thereof include anthraquinone, alizarin, quinizarin, anthrarufin, and purpurin.

The content of the acceptor compound may be arbitrarily selected, but the content of the acceptor compound may be from 0.01% by weight to 20% by weight based on the inorganic particles, and preferably from 0.05% by weight to 10% by weight based on the inorganic particles.

The acceptor compound may be added during application of the undercoat layer 4, or may be adhered to the inorganic particle surface in advance. Examples of the method for adhering the acceptor compound to the inorganic particle surface include a dry method or a wet method.

When the surface treatment is carried out by a dry method, the treatment is carried out by adding an acceptor compound dropwise directly or after dissolving it in an organic solvent, and spraying the compound together with dry air or nitrogen gas, while agitating the inorganic particles in a high-shear-force mixer. During addition or spraying, the treatment is preferably carried out at a temperature of the boiling point of the solvent or lower. The inorganic particles after addition or spraying may be baked additionally at 100° C. or higher. The temperature range and the time of the baking are set arbitrarily.

In the wet method, the inorganic particles are treated by stirring the inorganic particles in a solvent, dispersing the inorganic particles using an ultrasonicator, a sand mill, an attritor, a ball mill, or the like, adding an acceptor compound thereto, followed by stirring or dispersing, and then removing the solvent. The solvent is removed by filtration or distillation. The inorganic particles may be baked additionally at a temperature of 100° C. or higher after removing the solvent. The temperature range and the time of the baking are set arbitrarily. Water contained in the inorganic particles may be removed before addition of a surface treatment agent in the wet method, and as an example of the method, a method may used, in which the solvent is removed by heating particles with stirring in a solvent used for a surface treatment or a method in which the solvent is removed by azeotropy with the solvent.

The inorganic particles may be subjected to a surface treatment before applying the acceptor compound. The surface treatment agent is selected from known materials. Examples thereof include a silane coupling agent, a titanate coupling agent, an aluminum coupling agent, and a surfactant. Particularly, a silane coupling agent is preferably used. Furthermore, a silane coupling agent having an amino group is preferably used.

As the silane coupling agent having an amino group, any one may be used, but specific examples thereof include γ-aminopropyltriethoxysilane, N-β-(aminoethyl)-γ-aminopropyltrimethoxysilane, N-β-(aminoethyl)-γ-aminopropylmethylmethoxysilane, and N,N-bis(β-hydroxyethyl)-γ-aminopropyltriethoxysilane, but not limited thereto.

The silane coupling agents may be used in a mixture of two or more kinds thereof. Examples of the silane coupling agent that is used in combination with the silane coupling agent having an amino group include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxylsilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxylsilane, and γ-chloropropyltrimethoxysilane, but not limited thereto.

Any known surface treatment methods may be used, but it is preferable to use a dry or wet method. Further, application of an acceptor may be carried out in combination with a surface treatment using a coupling agent or the like.

The amount of the silane coupling agent based on the inorganic particles in the undercoat layer 4 may be selected arbitrarily, but it is preferably from 0.5% by weight to 10% by weight based on the inorganic particles.

As the binder resin to be included in the undercoat layer 4, any known binder resin may be used. Examples thereof include: known polymer resin compounds including an acetal resin such as polyvinyl butyral, a polyvinyl alcohol resin, casein, a polyimide resin, a cellulosic resin, gelatin, a polyurethane resin, a polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a phenol resin, a phenol-formaldehyde resin, a melamine resin, and a urethane resin; charge transporting resins having a charge transporting group; and electroconductive resins such as polyaniline. Among them, a resin insoluble in the coating solution for an upper layer is preferably used, and a phenol resin, a phenol-formaldehyde resin, a melamine resin, a urethane resin, an epoxy resin, or the like is particularly preferably used. When a combination of two or more kinds thereof is used, the mixing ratio is selected according to the purposes.

The ratio of the metal oxides to which an acceptor property has been imparted to the binder resin, or the ratio of the inorganic particles to the binder resin in the coating liquid for forming an undercoat layer may be selected arbitrarily.

The undercoat layer 4 may further contain any of various additives. Examples of the additives include electron transporting pigments such as a condensed polycyclic pigment or an azo pigment, or known materials such as a zirconium chelate compound, a titanium chelate compound, an aluminum chelate compound, a titanium alkoxide compound, an organic titanium compound, or a silane coupling agent. The silane coupling agent is used for the surface treatment of metal oxides, but it may be used also as an additive in the coating liquid. Specific examples of the silane coupling agent as used in this context include vinyltrimethoxysilane, γ-methacryloxypropyl-tris(β-methoxyethoxy) silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxylsilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane.

Examples of the zirconium chelate compound include zirconium butoxide, ethyl acetoacetate zirconium, zirconium triethanolamine, acetylacetonate zirconium butoxide, zirconium ethyl acetoacetate butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compound include tetraisopropyl titanate, tetra-n-butyl titanate, a butyl titanate dimer, tetra(2-ethylhexyl) titanate, titanium acetylacetonate, polytitanium acetylacetonate, titanium octyleneglycolate, a titanium lactate ammonium salt, titanium lactate, titanium lactate ethyl ester, titanium triethanolaminate, and polyhydroxytitanium stearate.

Examples of the aluminum chelate compound include aluminum isopropylate, monobutoxyaluminum diisopropylate, aluminum butylate, ethyl acetoacetate aluminum diisopropylate, and aluminum tris(ethyl acetoacetate).

These compounds may be used alone, or as a mixture or a polycondensate of plural thereof.

The solvent to be used for preparing the coating liquid for forming an undercoat layer is selected from known organic solvents, for example, alcohols, aromatic compounds, halogenated hydrocarbons, ketones, ketone alcohols, ethers, and esters. Example of the solvents include common organic solvents such as methanol, ethanol, n-propanol, iso-propanol, n-butanol, benzylalcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

The solvents to be used for dispersion may be used alone, or as a mixture of two or more kinds thereof. Any solvents may be used as a mixed solvent used in mixing as long as the solvent enables dissolution of the binder resin.

As the dispersing method, a known method using a roll mill, a ball mill, a vibration ball mill, an attritor, a sand mill, a colloid mill, a paint shaker, or the like is used. As the coating method used for preparing the undercoat layer 4, a common method such as a blade coating method, a wire bar coating method, a spray coating method, a dip coating method, a bead coating method, an air knife coating method, or a curtain coating method may be used.

The undercoat layer 4 is formed on a substrate 1 by using the coating liquid for forming an undercoat layer thus obtained.

The undercoat layer 4 may have a Vickers' strength of 35 or more.

The undercoat layer 4 may have any thickness, but preferably has a thickness of 15 μm or more, and more preferably from 15 μm to 50 μm.

The surface roughness (average roughness at ten points) of the undercoat layer 4 is adjusted to ¼n (in which "n" represents the refractive index of an upper layer) to ½λ, of the wavelength λ, of an exposure laser to be used, from the viewpoint of prevention of moire images. Particles of a resin or the like may be added to the undercoat layer for adjustment of the surface roughness. As the resin particles, silicone resin particles, crosslinked methyl polymethacrylate resin particles, or the like are used.

The undercoat layer may be polished for adjustment of the surface roughness. Examples of the polishing method include buffing polishing, sand blasting polishing, wet honing, and grinding treatment.

The undercoat layer is obtained by dying the coated coating liquid. In general, drying is carried out by evaporating the solvent at a temperature that enables formation of a film of the coating liquid.

Charge Generating Layer

The charge generating layer 2A may be a layer including at least a charge generating material and a binder resin.

Examples of the charge generating material include azo pigments such as a bisazo pigment or a trisazo pigment, condensed aromatic pigments such as dibromoanthanthrone, perylene pigments, pyrrolopyrrole pigments, phthalocyanine pigments, zinc oxide, and trigonal selenium. Among these, examples of the pigments preferably used for laser exposure in the near-infrared wavelength region include metallic and/or non-metallic phthalocyanine pigments, and more preferred are hydroxygallium phthalocyanine as disclosed in Japanese Patent Application Laid-Open (JP-A) Nos. 5-263007 and 5-279591, chlorogallium phthalocyanine as disclosed in JP-A No. 5-98181 or the like, dichloro tin phthalocyanine as disclosed in JP-A Nos. 5-140472 and 5-140473, and titanyl phthalocyanine disclosed in JP-A Nos. 4-189873 and 5-43813, or the like. Examples of the pigments preferably used for laser exposure in the near-ultraviolet wavelength region include condensed aromatic pigments such as dibromoanthanthrone, thioindigo pigments, porphyrazine compounds, zinc oxide, and trigonal selenium. When a light source of an exposure wavelength of from 380 nm to 500 nm is used, an inorganic pigment is preferably used as the charge generating material, and when a light source of an exposure wavelength of from 700 nm to 800 nm is used, metallic and non-metallic phthalocyanine pigments are preferably used.

As the charge generating material, a hydroxygallium phthalocyanine pigment having a maximum peak wavelength in the range from 810 nm to 839 nm in the absorption spectrogram in the range from 600 nm to 900 nm, may be used. This hydroxygallium phthalocyanine pigment is different from the conventional V-type hydroxygallium phthalocyanine pigments, and has a maximum peak wavelength of the absorption spectrogram at a relatively shorter wavelength as compared to that of the conventional V-type hydroxygallium phthalocyanine pigments.

It is preferable that the hydroxygallium phthalocyanine pigment having a maximum peak wavelength in the range from 810 nm to 839 nm has an average particle diameter in a specific range, and a BET specific surface area in a specific range. More specifically, the average particle diameter of the hydroxygallium phthalocyanine pigment is preferably 0.20 μm or less, and more preferably from 0.01 μm to 0.15 μm, and the BET specific surface area thereof is preferably 45 $m^2/g$ or more, more preferably 50 $m^2/g$ or more, and particularly preferably from 55 $m^2/g$ to 120 $m^2/g$. The average particle diameter is a volume average particle diameter (d50 average particle diameter) measured using a laser diffraction/scattering particle size distribution analyzer (LA-700, trade name, manufactured by Horiba Ltd.), and the specific surface area is a value obtained using a BET specific surface area analyzer (FLOWSORB II2300, trade name, manufactured by Shimadzu Corporation).

The maximum particle diameter (maximum value of primary particle diameters) of the hydroxygallium phthalocyanine pigment is preferably 1.2 μm or less, more preferably 1.0 μm or less, and further preferably 0.3 μm or less.

It is preferable that the hydroxygallium phthalocyanine pigment has an average particle diameter of 0.2 μm or less, a maximum particle diameter of 1.2 μm or less, and a specific surface area of 45 $m^2/g$ or more.

The hydroxygallium phthalocyanine pigment preferably has diffraction peaks at Bragg angles (2θ±0.2°) of 7.5°, 9.9°, 12.5°, 16.3°, 18.6°, 25.1°, and 28.3° in the X-ray diffraction spectrogram using a CuKα characteristic x-ray.

The ratio of thermogravimetric weight loss of the hydroxygallium phthalocyanine pigment may be from 2.0% to 4.0%, and more preferably from 2.5% to 3.8%, when the temperature is raised from 25° C. to 400° C.

The binder resin used in the charge generating layer 2A is selected from various insulating resins, and may be selected from organic photoconductive polymers such as poly-N-vinyl carbazole, polyvinyl anthracene, polyvinyl pyrene, or polysilane. Examples of the binder resin include a polyvinyl butyral resin, a polyarylate resin (e.g., polycondensates of bisphenols and aromatic divalent carboxylic acids), a polycarbonate resin, a polyester resin, a phenoxy resin, a vinyl chloride-vinyl acetate copolymer, a polyamide resin, an acrylic resin, a polyacrylamide resin, a polyvinyl pyridine resin, a cellulose resin, a urethane resin, an epoxy resin, casein, a polyvinyl alcohol resin, and a polyvinyl pyrrolidone resin. These binder resins may be used alone or in combination of two or more kinds thereof. The mixing ratio between the charge generating material and the binder resin (i.e., charge generating material:binder resin) may be in the range of from 10:1 to 1:10 by weight ratio. Herein, the term "insulating property" means that the volume resistivity is $10^{13}$ Ω·cm or more.

The charge generating layer 2A is formed, for example, using a coating liquid in which the charge generating material and the binder resin are dispersed in a solvent.

Examples of the solvent used for dispersion include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. The solvents may be used alone or in combination of two or more kinds thereof.

As the method for dispersing the charge generating material and the binder resin in a solvent, a common method such as a ball mill dispersion method, an attritor dispersion method, or a sand mill dispersion method may be used. The average particle diameter of the charge generating material after the dispersing treatment may be 0.5 μm or less, more preferably 0.3 μm or less, and further preferably 0.15 μm or less.

In order to form the charge generating layer 2A, a common method such as a blade coating method, a Meyer bar coating method, a spray coating method, a dip coating method, a bead coating method, an air knife coating method, or a curtain coating method may be used.

The film thickness of the charge generating layer 2A thus obtained may be from 0.1 μm to 5.0 μm, and more preferably from 0.2 μm to 2.0 μm.

Charge Transporting Layer

The charge transporting layer 2B may be a layer including at least a charge transporting material and a binder resin, or a layer including at least a polymer charge transporting material.

Examples of the charge transporting material include: electron transporting compounds including quinone compounds such as p-benzoquinone, chloranil, bromanil, or anthraquinone, tetracyanoquinodimethane compounds, fluorenone compounds such as 2,4,7-trinitrofluorenone, xanthone compounds, benzophenone compounds, cyanovinyl compounds, or ethylene compounds; and positive hole transporting compounds including triarylamine compounds, benzidine compounds, arylalkane compounds, aryl-substituted ethylene compounds, stilbene compounds, anthracene compounds, or hydrazone compounds. The charge transporting materials may be used alone or in combination of two or more kinds thereof, but are not limited thereto.

The charge transporting material is preferably a triarylamine derivative represented by the following Structural Formula (a-1) or a benzidine derivative represented by the following Structural Formula (a-2), from the viewpoints of charge mobility.

(a-1)

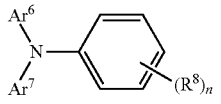

In Structural Formula (a-1), $R^8$ represents a hydrogen atom or a methyl group; n represents 1 or 2; $Ar^6$ and $Ar^7$ each independently represent a substituted or unsubstituted aryl group, $—C_6H_4—C(R^9)=C(R^{10})(R^{11})$, or $—C_6H_4—CH=CH—CH=C(R^{12})(R^{13})$, in which $R^9$ to $R^{13}$ each independently represent a hydrogen atom, a substituted or unsubstituted alkyl group, or a substituted or unsubstituted aryl group. When a group in Formula (a-1) is substituted, the substituent may be a halogen atom, an alkyl group having 1 to 5 carbon atoms, an alkoxy group having 1 to 5 carbon atoms, or a substituted amino group substituted with an alkyl group having 1 to 3 carbon atoms.

(a-2)

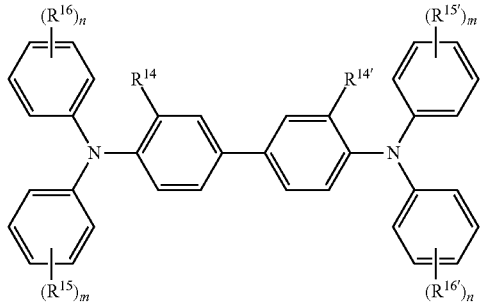

In Structural Formula (a-2), $R^{14}$ and $R^{14'}$ may be the same as or different from each other, and each independently represent a hydrogen atom, a halogen atom, an alkyl group having 1 to 5 carbon atoms, or an alkoxy group having 1 to 5 carbon atoms; $R^{15}$, $R^{15'}$, $R^{16}$, and $R^{16'}$ may be the same as or different from each other, and each independently represent a hydrogen atom, a halogen atom, an alkyl group having 1 to 5 carbon atoms, an alkoxy group having 1 to 5 carbon atoms, an amino group substituted with an alkyl group having 1 to 2 carbon atoms, a substituted or unsubstituted aryl group, $—C(R^{17})=C(R^{18})(R^{19})$, or $—CH=CH—CH=C(R^{20})(R^{21})$, in which $R^{17}$ to $R^{21}$ each independently represent a hydrogen atom, a substituted or unsubstituted alkyl group, or a substituted or unsubstituted aryl group; and m and n each independently represent an integer from 0 to 2.

Among the triarylamine derivatives represented by Structural Formula (a-1) and the benzidine derivatives represented by Structural Formula (a-2), triarylamine derivatives having "$—C_6H_4—CH=CH—CH=C(R^{12})(R^{13})$" in its structure and benzidine derivatives having) "$—CH=CH—CH=C(R^{20})(R^{21})$" in its structure are preferable.

Examples of the binder resin used for the charge transporting layer 2B include a polycarbonate resin, a polyester resin, a polyarylate resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone alkyd resin, a phenol-formaldehyde resin, a styrene-alkyd resin, a poly-N-vinyl carbazole, and a polysilane. As described above, the polyester polymer charge transporting materials and the like as disclosed in JP-A Nos. 8-176293 and 8-208820 may be used as a binder resin. These binder resins may be used alone or in combination of two or more kinds thereof. The blending ratio between the charge transporting material and the binder resin (i.e., charge transporting material:binder resin) may be from 10:1 to 1:5 by weight ratio.

The binder resin is not particularly limited, but is preferably at least one selected from the group consisting of a polycarbonate resin having a viscosity average molecular weight of from 50,000 to 80,000, and a polyarylate resin having a viscosity average molecular weight of from 50,000 to 80,000.

As the charge transporting material, a polymer charge transporting material may be used. As the polymer charge transporting material, known materials having charge transporting properties, such as poly-N-vinyl carbazole or polysilane may be used. The polyester polymer charge transporting materials as disclosed in JP-A Nos. 8-176293 and 8-208820 are particularly preferred. The polymer charge transporting materials are capable of forming a film by itself, but may be mixed with a binder resin as described below to form a film.

The charge transporting layer 2B is formed, for example, using a coating liquid for forming a charge transporting layer, which contains the above-mentioned constituent materials. Examples of the solvent used for the coating liquid for forming a charge transporting layer include ordinary organic solvents including: aromatic hydrocarbons such as benzene, toluene, xylene, or chlorobenzene; ketones such as acetone or 2-butanone; halogenated aliphatic hydrocarbons such as methylene chloride, chloroform, or ethylene chloride; and cyclic or linear ethers such as tetrahydrofuran or ethyl ether. These solvents may be used alone or in combination of two or more kinds thereof. Any known method may be used as a method for dispersing each of the constituent materials.

Examples of the method for applying the coating liquid for forming a charge transporting layer onto the charge generating layer 2A include common methods such as a blade coating method, a Meyer bar coating method, a spray coating method, a dip coating method, a bead coating method, an air knife coating method, and a curtain coating method.

The film thickness of the charge transporting layer 2B may be from 5 μm to 50 μm, and more preferably from 10 μm to 30 μm.

Surface Protective Layer (Protective Layer)

The protective layer 5, which is a surface protective layer in the first exemplary embodiment, includes at least a component (A) and a component (B) as described below:

(A) a crosslinked product formed from a compound having a guanamine structure or a melamine structure and a compound containing a charge transporting material having at least one substituent selected from the group consisting of —OH, $—OCH_3$, $—NH_2$, —SH, and —COOH (hereinafter simply referred to as "specific charge transporting material"); and (B) fluorinated resin particles.

Furthermore, the surface protective layer may further contain (C) other compositions.

Component (A)

The component (A) is a crosslinked product formed from a compound having a guanamine structure or a melamine structure and a compound containing a charge transporting material having at least one substituent selected from the group consisting of —OH, $—OCH_3$, $—NH_2$, —SH, and —COOH (hereinafter may be simply referred to as "specific charge transporting material").

The protective layer 5 according to the first exemplary embodiment may contain a crosslinked product formed from a compound having a guanamine structure or a melamine structure and a specific charge transporting material. The content of the charge transporting material in the protective layer 5 is from 90% by weight to 98% by weight, and more preferably from 90% by weight to 95% by weight. The content of the fluorinated resin particle in the protective layer 5 is from 2% by weight to 10% by weight, and more preferably from 5% by weight to 10% by weight.

First, the compound having a guanamine structure (i.e., guanamine compound) will be described.

The guanamine compound is a compound having a guanamine backbone (guanamine structure), and examples thereof include acetoguanamine, benzoguanamine, formoguanamine, steroguanamine, spiroguanamine, and cyclohexylguanamine.

In particular, the guanamine compound is preferably at least one of a compound represented by the following Formula (A) and multimers thereof. The multimers are oligomers obtained by polymerization of the compound represented by Formula (A) as a structural unit, and have a polymerization degree of, for example, from 2 to 200, and preferably from 2 to 100. Only one kind of the compound represented by Formula (A) or multimers thereof may be used, or a combination of two or more kinds thereof may be used.

Formula (A)

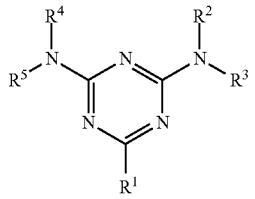

In Formula (A), $R^1$ represents a linear or branched alkyl group having 1 to 10 carbon atoms, a substituted or unsubstituted phenyl group having 6 to 10 carbon atoms, or a substituted or unsubstituted alicyclic hydrocarbon group having 4 to 10 carbon atoms; $R^2$ to $R^5$ each independently represent a hydrogen atom, —$CH_2$—OH, or —$CH_2$—O—$R_6$, wherein $R^6$ is a hydrogen atom or a linear or branched alkyl group having 1 to 10 carbon atoms.

In Formula (A), the alkyl group represented by $R^1$ has 1 to 10 carbon atoms, preferably 1 to 8 carbon atoms, and further preferably 1 to 5 carbon atoms. The alkyl group may be linear or branched.

In Formula (A), the phenyl group represented by $R^1$ has 6 to 10 carbon atoms, and preferably 6 to 8 carbon atoms. Examples of the substituent which may substitutes the phenyl group include a methyl group, an ethyl group, and a propyl group.

In Formula (A), the alicyclic hydrocarbon group represented by $R^1$ has 4 to 10 carbon atoms, and more preferably 5 to 8 carbon atoms. Examples of the substituent which may substitutes the alicyclic hydrocarbon group include a methyl group, an ethyl group, and a propyl group.

In the "—$CH_2$—O—$R_6$" represented by any of $R^2$ to $R^5$ in Formula (A), the alkyl group represented by $R^6$ has 1 to 10 carbon atoms, preferably 1 to 8 carbon atoms, and more preferably 1 to 6 carbon atoms, and the alkyl group may be linear or branched. Preferable examples of the alkyl group may include a methyl group, an ethyl group, and a butyl group.

The compound represented by Formula (A) is particularly preferably a compound represented by Formula (A), wherein $R^1$ is a substituted or unsubstituted phenyl group having 6 to 10 carbon atoms, and $R^2$ through $R^5$ are each independently —$CH_2$—O—$R^6$, in which $R^6$ is preferably selected from a methyl group and an n-butyl group.

The compound represented by Formula (A) may be synthesized from, for example, guanamine and formaldehyde according to a known method (see, for example, Jikken Kagaku Kohza (Experimental Chemical Lecture), 4th Edition, Vol. 28, p. 430).

Hereinbelow, specific examples of the compound represented by Formula (A) are shown, but are not limited thereto. The following specific examples are shown in the form of a monomer, but multimers (e.g., oligomers) of there specific examples as structural units may be used.

(A)-1

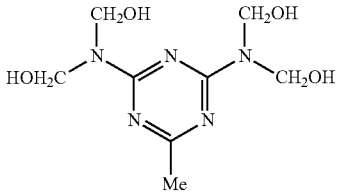

(A)-2

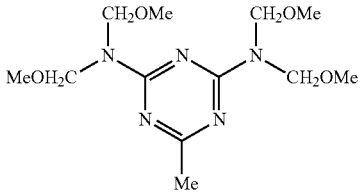

(A)-3

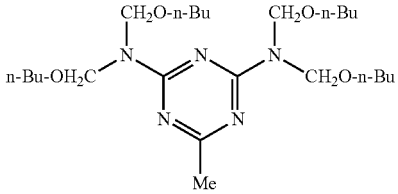

(A)-4

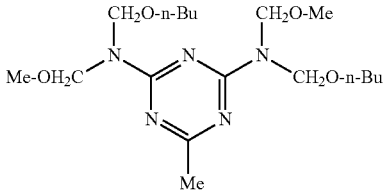

(A)-5

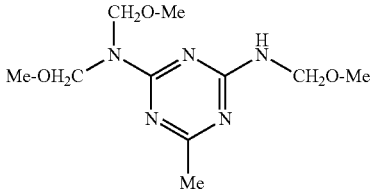

(A)-6

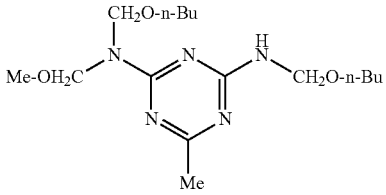

(A)-7

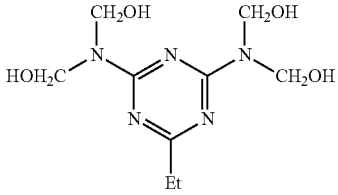

(A)-8

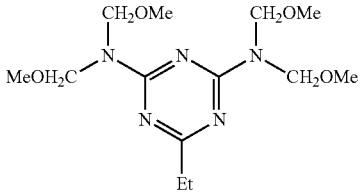

-continued
(A)-9
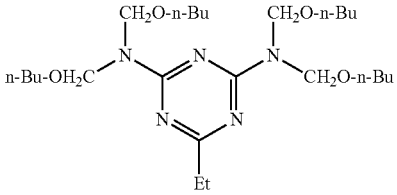
(A)-10
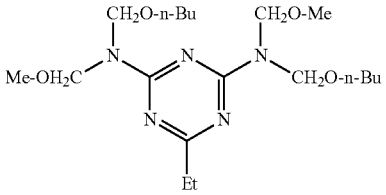
(A)-11
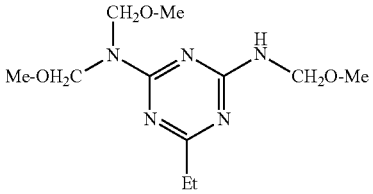
(A)-12
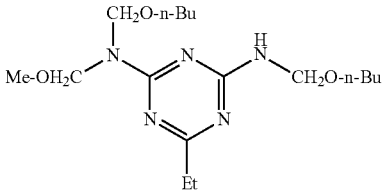
(A)-13
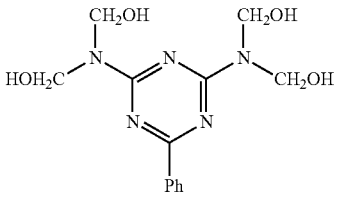
(A)-14
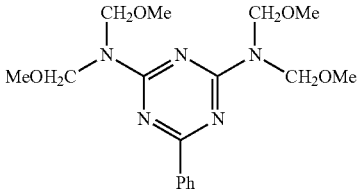
(A)-15
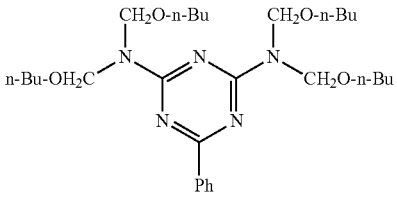
(A)-16
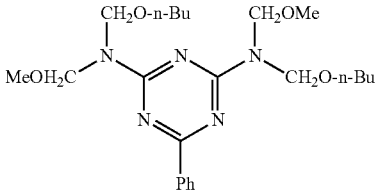
-continued
(A)-17
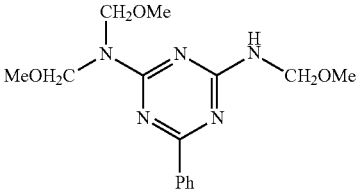
(A)-18
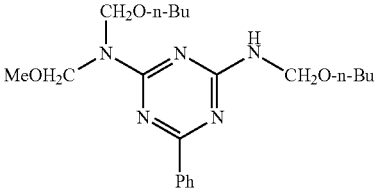
(A)-19
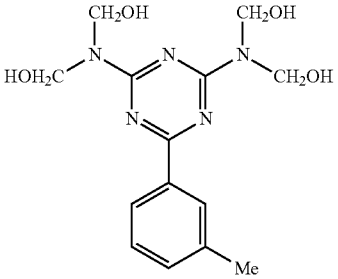
(A)-20
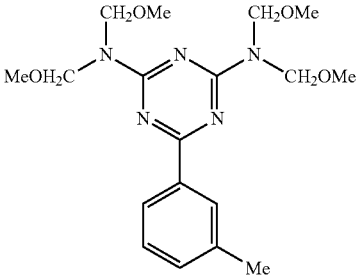
(A)-21
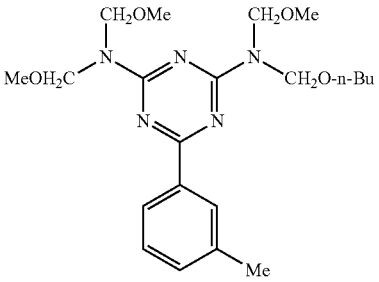
(A)-22
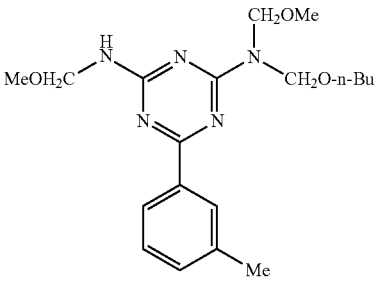

-continued
(A)-23
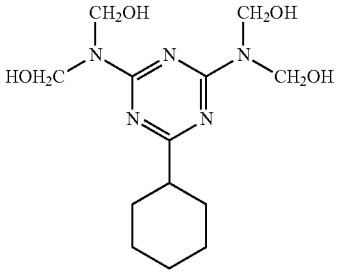
(A)-24
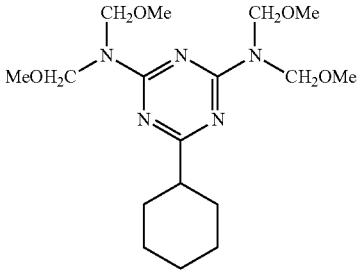
(A)-25
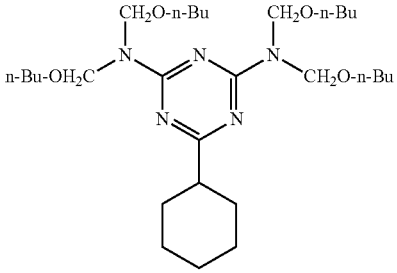
(A)-26
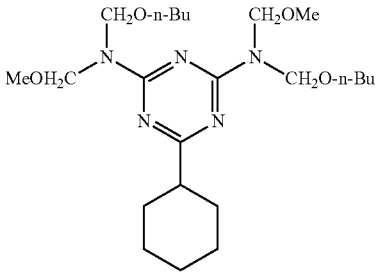
(A)-27
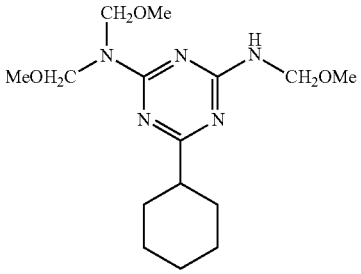
-continued
(A)-28
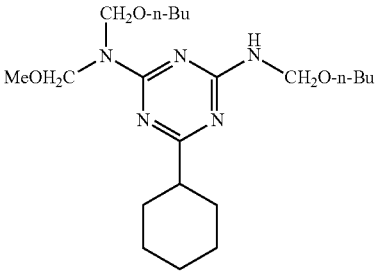
(A)-29
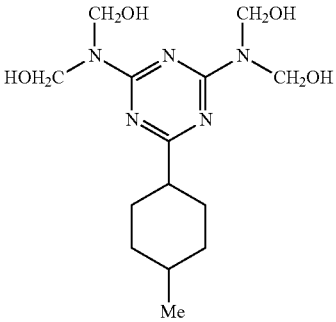
(A)-30
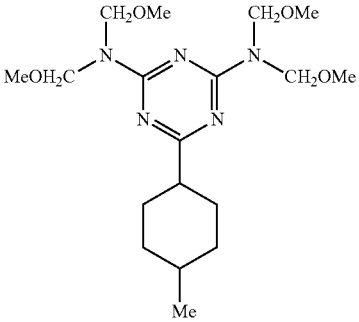
(A)-31
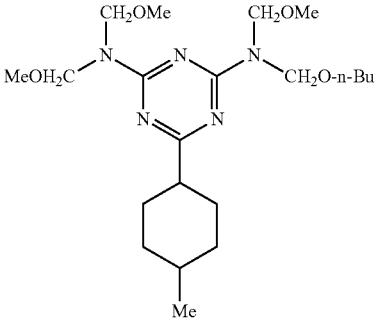
(A)-32
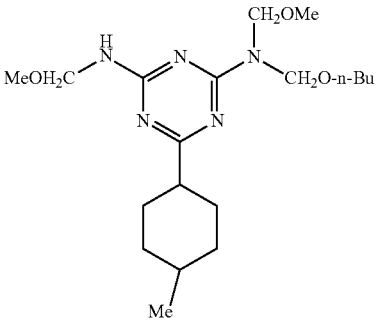

-continued (A)-33

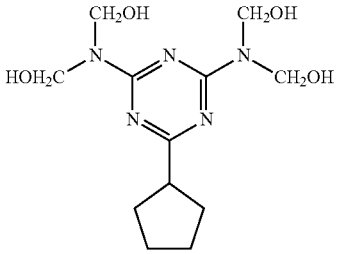

(A)-34

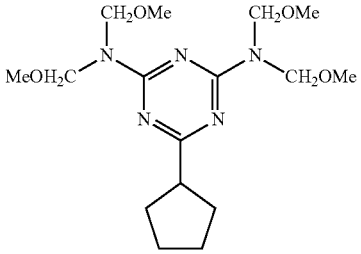

(A)-35

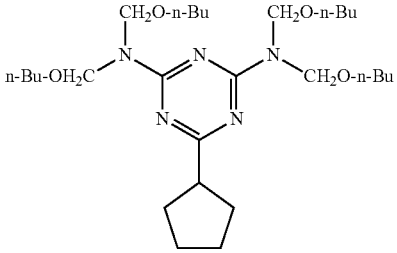

(A)-36

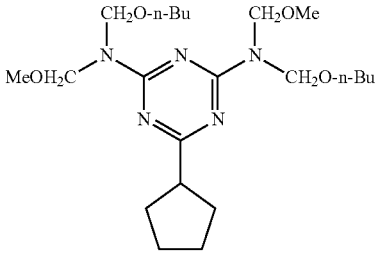

(A)-37

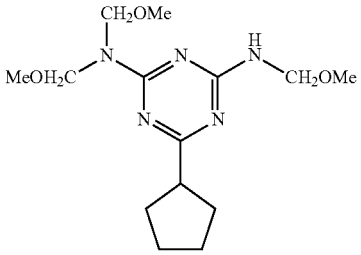

(A)-38

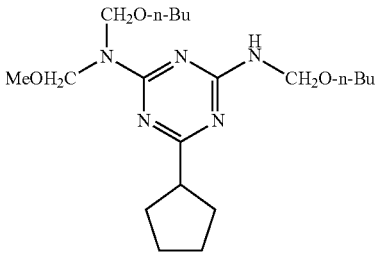

-continued (A)-39

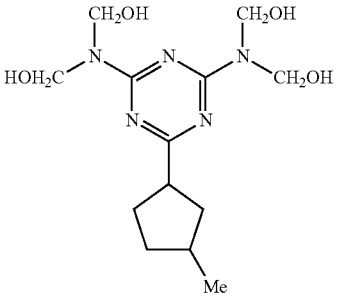

(A)-40

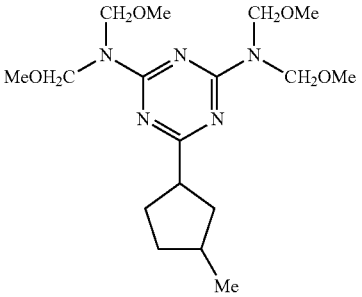

(A)-41

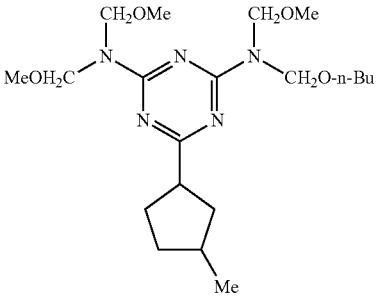

(A)-42

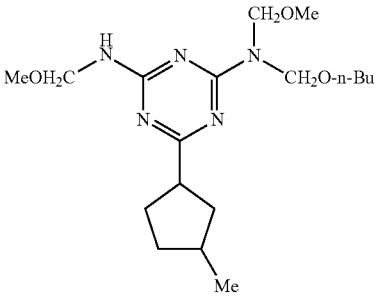

Examples of commercial products of the compound represented by Formula (A) include SUPER BECKAMIN® L-148-55, SUPER BECKAMIN® 13-535, SUPER BECKAMIN® L-145-60, and SUPER BECKAMIN® TD-126 (all manufactured by DIC Corporation), and NIKALACK BL-60 and NIKALACK BX-4000" (trade names, all manufactured by Nippon Carbide Industries Co., Inc.).

In order to avoid the influence of the residual catalyst, after the compound represented by Formula (A) (including multimers) is synthesized or purchased as a commercially available product, the compound may be dissolved in an appropriate solvent such as toluene, xylene, or ethyl acetate, and then may be subjected to washing with distilled water or ion-exchange water, or a treatment with an ion-exchange resin.

Next, the compound having a melamine structure (i.e., melamine compound) is explained.

The melamine compound has a melamine backbone (melamine structure), and is particularly preferably at least one of a compound represented by the following Formula (B) and multimers thereof. Herein, similarly to the case of Formula (A), the multimers are oligomers obtained by polymerization of the compound represented by Formula (B) as a structural unit, and have a polymerization degree of, for example, from 2 to 200, and preferably from 2 to 100. Only one kind of the compound represented by Formula (B) or multimers thereof may be used, or a mixture of two or more kinds thereof may be used. Alternatively, the compound represented by Formula (B) or a multimer thereof may be used in combination with the compound represented by Formula (A) or a multimer thereof.

Formula (B)

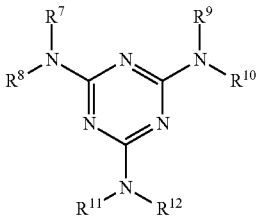

In Formula (B), $R^7$ to $R^{12}$ each independently represent a hydrogen atom, —$CH_2$—OH or —$CH_2$—O—$R^{13}$, wherein $R^{13}$ represents an alkyl group which has 1 to 5 carbon atoms and which may be branched. Examples of $R^{13}$ include a methyl group, an ethyl group, and a butyl group.

The compound represented by Formula (B) is synthesized from, for example, melamine and formaldehyde according to a known method (for example, in the same manner as that of the melamine resin described in the fourth series of Experimental Chemistry, Vol. 28, p. 430).

Specific examples of the compound represented by Formula (B) include, but are not limited to, the compounds shown below. These specific examples are shown in the form of a monomer, but the compound may be in the form of a multimer (e.g., oligomer) in which the monomer is used as a structural unit.

(B)-1

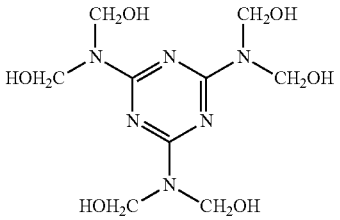

(B)-2

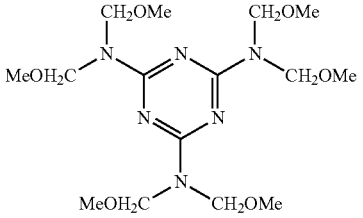

-continued (B)-3

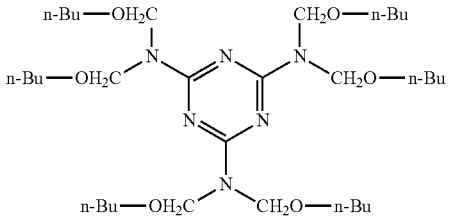

(B)-4

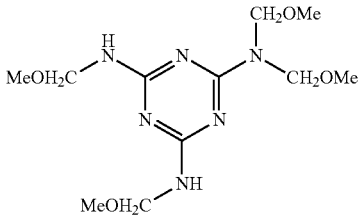

(B)-5

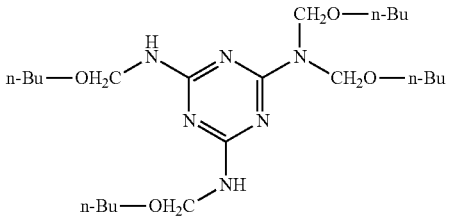

(B)-6

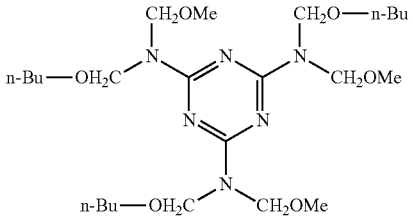

(B)-7

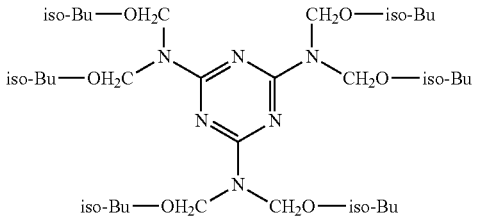

Examples of commercial products of the compound represented by Formula (B) include SUPERM ELAMI No. 90 (trade name, manufactured by NOF Corporation), SUPER BECKAMIN® TD-139-60 (manufactured by DIC Corporation), U-VAN 2020 (trade name, manufactured by Mitsui Chemicals Inc.), SUMITEX RESIN M-3 (trade name, manufactured by Sumitomo Chemical Co., Ltd.), and NIKALACK MW-30 (trade name, manufactured by Nippon Carbide Industries Co., Inc.).

In order to avoid the influence of the residual catalyst, after the compound represented by Formula (B) (including multimers) is synthesized or purchased as a commercially available product, the compound may be dissolved in an appropriate solvent such as toluene, xylene, or ethyl acetate, and then may be subjected to washing with distilled water or ion-exchange water, or a treatment with an ion-exchange resin.

Next, the specific charge transporting material will be described.

Examples of the specific charge transporting material include those having at least one substituent selected from the group consisting of —OH, —$OCH_3$, —$NH_2$, —SH, and —COOH (which may be hereinafter referred to as a "specific reactive functional group" in some cases). The specific charge transporting material particularly preferably has at least two substituents (more preferably, three substituents) selected from the group consisting of the reactive functional groups.

The specific charge transporting material is preferably a compound represented by the following Formula (I).

$$F—((—R^7—X)_{n1}(R^8)_{n3}—Y)_{n2} \quad \text{Formula (I)}$$

In Formula (I), F represents an organic group derived from a compound having a positive hole transporting ability; $R^7$ and $R^8$ each independently represent a linear or branched alkylene group having 1 to 5 carbon atoms; n1 represents 0 or 1; n2 represents an integer from 1 to 4; n3 represents 0 or 1; X represents an oxygen atom, NH, or a sulfur atom; and Y represents —OH, —$OCH_3$, —$NH_2$, —SH, or —COOH (i.e., the specific reactive functional group).

In the organic group represented by F, which is derived from a positive hole transporting compound, shown in Formula (I), preferable examples of the positive hole transporting compound include an arylamine derivative. Examples of the arylamine derivative include a triphenylamine derivative and a tetraphenylbenzidine derivative.

The compound represented by Formula (I) is preferably a compound represented by the following Formula (II).

(II)

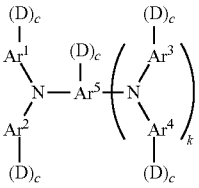

In Formula (II), $Ar^1$ to $Ar^4$ may be the same as or different from each other, and each independently represent a substituted or unsubstituted aryl group; $Ar^5$ represents a substituted or unsubstituted aryl group or a substituted or unsubstituted arylene group; D's each independently represent —(—$R^7$—X)$_{n1}$($R^8$)$_{n3}$—Y and may be the same as or different from each other; each c independently represents 0 or 1; k represents 0 or 1; the total number of D's is from 1 to 4; $R^7$ and $R^8$ each independently represent a linear or branched alkylene group having 1 to 5 carbon atoms; n1 represents 0 or 1; n3 represents 0 or 1; X represents an oxygen atom, NH or a sulfur atom; and Y represents —OH, —$OCH_3$, —$NH_2$, —SH, or —COOH.

In Formula (II), "—(—$R^7$—X)$_{n1}$($R^8$)$_{n3}$—Y" represented by D has the same definition as that in Formula (I), and $R^7$ and $R^8$ each independently represent a linear or branched alkylene group having 1 to 5 carbon atoms. Furthermore, n1 is preferably 1, X is preferably an oxygen atom; and Y is preferably a hydroxyl group.

The total number of D's present in Formula (II) corresponds to n2 in Formula (I), and is preferably from 2 to 4, and more preferably from 3 to 4. In other words, a compound represented by Formula (I) or (II) preferably includes 2 to 4 specific reactive functional groups, and more preferably 3 or 4 specific reactive functional group in one molecule thereof.

In Formula (II), $Ar^1$ to $Ar^4$ each independently preferably represent any one of the following Formulae (a1) to (a7). In the following Formulae (a1) to (a7), "-$(D)_c$" which may be linked to any one of $Ar^1$ to $Ar^4$ is also shown.

(a1)

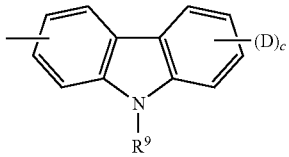

(a2)

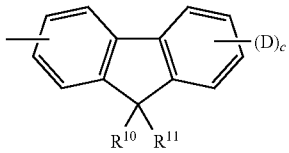

(a3)

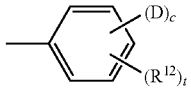

(a4)

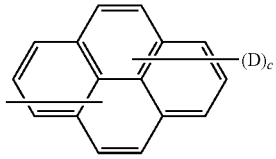

(a5)

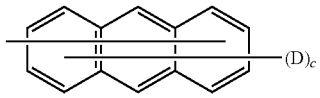

(a6)

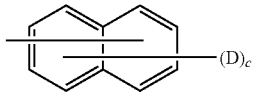

(a7)

In Formulae (a1) to (a7), $R^9$ represents one selected from the group consisting of a hydrogen atom, an alkyl group having 1 to 4 carbon atoms, a phenyl group substituted with an alkyl group having 1 to 4 carbon atoms or an alkoxy group having 1 to 4 carbon atoms, an unsubstituted phenyl group, and an aralkyl group having 7 to 10 carbon atoms; $R^{10}$ to $R^{12}$ each independently represent one selected from the group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom; Ar's each independently represent a substituted or unsubstituted arylene group; D has the same definition as "D" in Formula (II); c has the same definition as "c" in Formula (II); s represents 0 or 1; and t represents an integer from 1 to 3.

Herein, Ar in Formula (a7) is preferably one represented by the following Formula (a8) or (a9).

(a8)

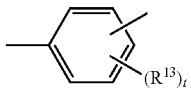

-continued (a9)

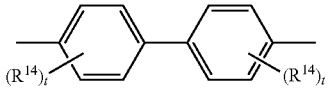

In Formulae (a8) and (a9), $R^{13}$ and $R^{14}$ each independently represent one selected from the group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom; and is each independently represent an integer from 1 to 3, and plural $R^{13}$'s may be the same as or different from each other, and plural $R^{14}$'s may be the same as or different from each other.

In Formula (a7), Z' is preferably one represented by any one selected from the following Formulae (a10) to (a17).

(a10) $—(CH_2)_q—$ (a11) $—(CH_2CH_2O)_r—$ (a12)

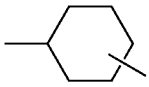

(a13)

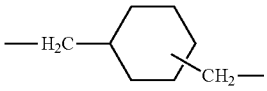

(a14)

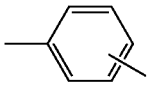

(a15)

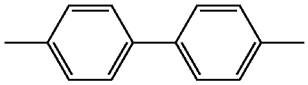

(a16)

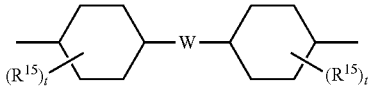

(a17)

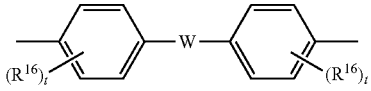

In Formulae (a10) to (a17), $R^{15}$ and $R^{16}$ each independently represent one selected from the group consisting of a hydrogen atom, an alkyl group having 1 to 4 carbon atoms, a phenyl group substituted with an alkoxy group having 1 to 4 carbon atoms or an alkoxy group having 1 to 4 carbon atoms, an unsubstituted phenyl group, an aralkyl group having 7 to 10 carbon atoms, and a halogen atom; W represents a divalent group; q and r each independently represent an integer from 1 to 10; and t represents an integer from 1 to 3; plural t's may be the same as or different from each other, plural $R^{13}$'s may be the same as or different from each other, and plural $R^{14}$'s may be the same as or different from each other.

In Formulae (a16) and (a17), W is preferably one of the divalent groups represented by Formulae (a18) to (a26). In Formula (a25), u represents an integer from 0 to 3.

(a18) $—CH_2—$ (a19) $—C(CH_3)_2—$ (a20) $—O—$ (a21) $—S—$ (a22) $—C(CF_3)_2—$ (a23) $—Si(CH_3)_2—$ (a24)

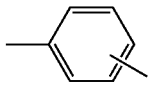

(a25)

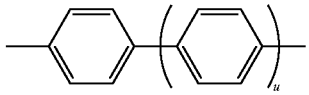

(a26)

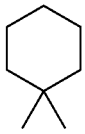

In Formula (II), it is preferable that when k is 0, $Ar^5$ is an aryl group represented by any one of Formula (a1) to (a7) as exemplified for $Ar^1$ to $Ar^4$, and when k is 1, $Ar^5$ is an arylene group obtained by removing one hydrogen atom from the aryl group represented by any one of Formula (a1) to (a7).

Specific examples of the compound represented by Formula (I) include the compounds (I-1) to (I-31) shown below, but not limited to these.

I-1

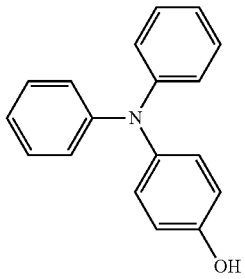

-continued
I-2
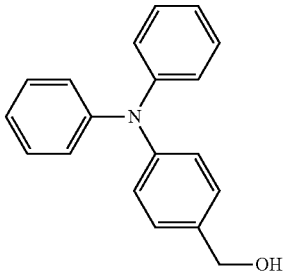
I-3
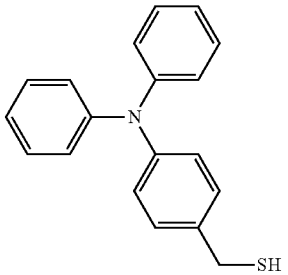
I-4
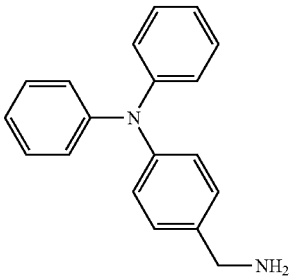
I-5
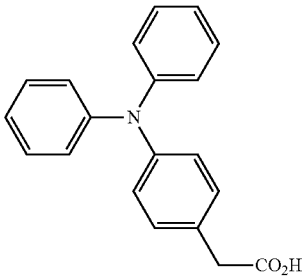
I-6
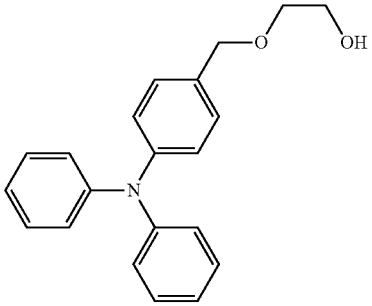

-continued
I-7
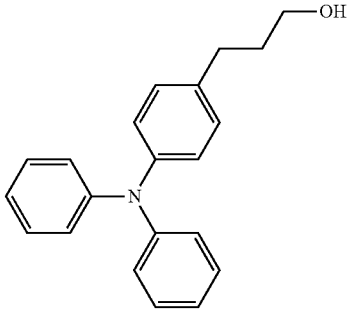
I-8
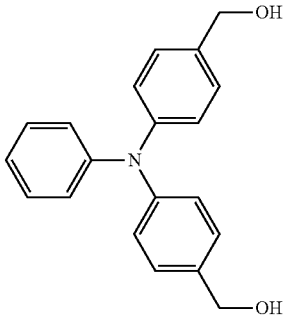
I-9
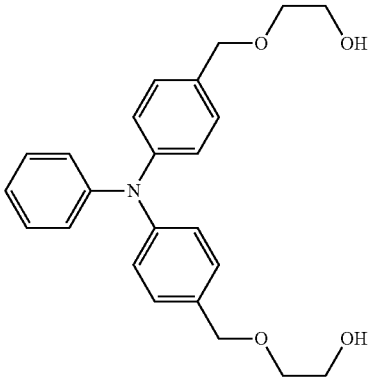
I-10
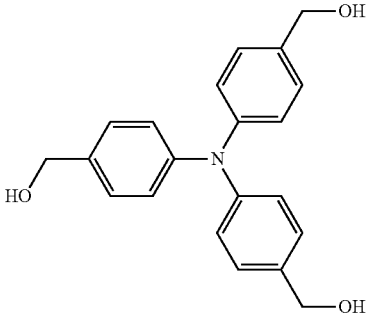

-continued
I-11
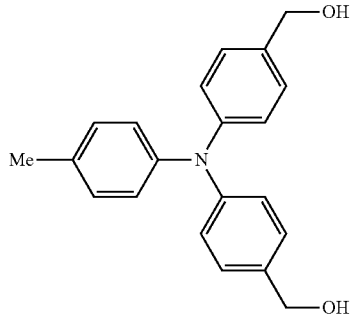
I-12
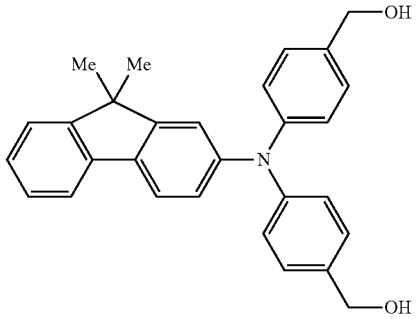
I-13
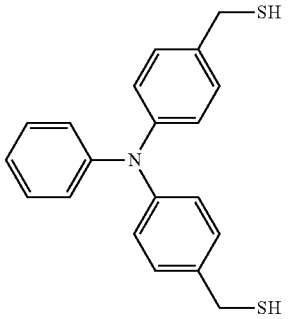
I-14
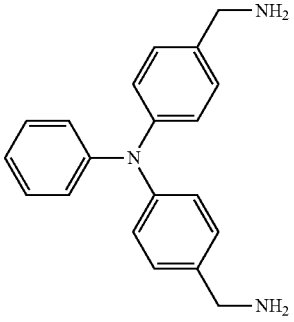
I-15
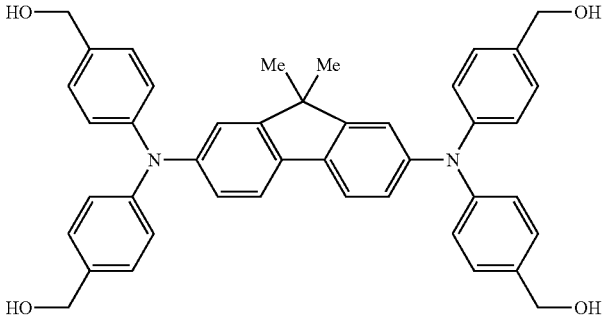

-continued
I-16
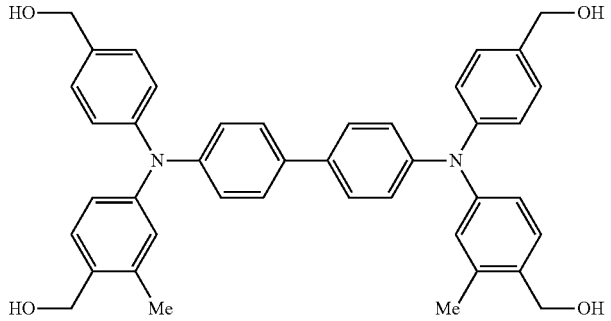
I-17
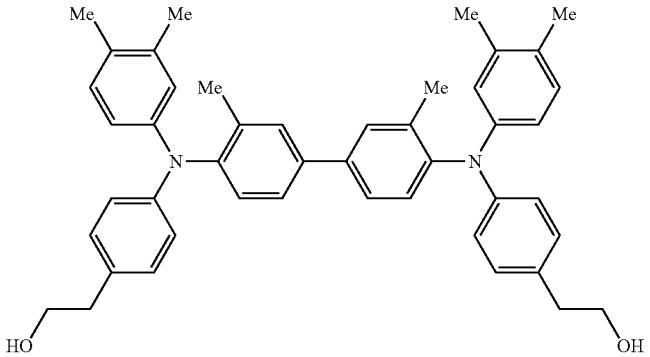
I-18
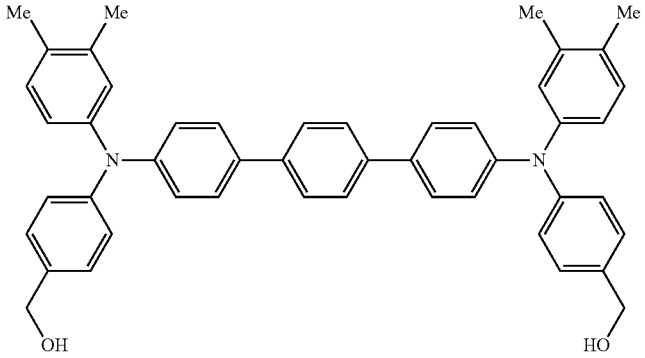
I-19
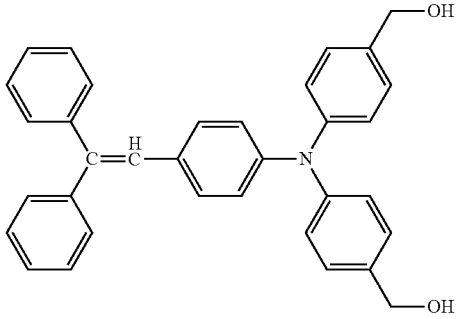

-continued
I-20
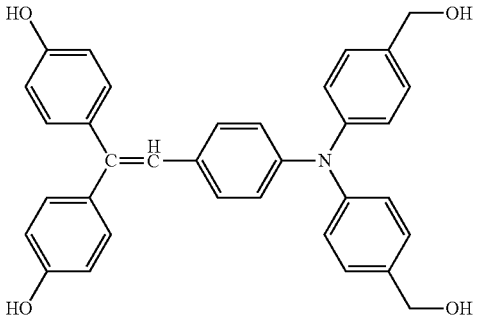
I-21
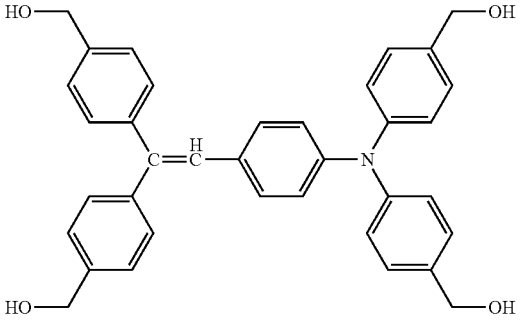
I-22
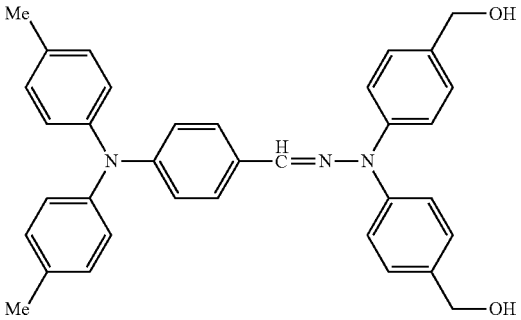
I-23
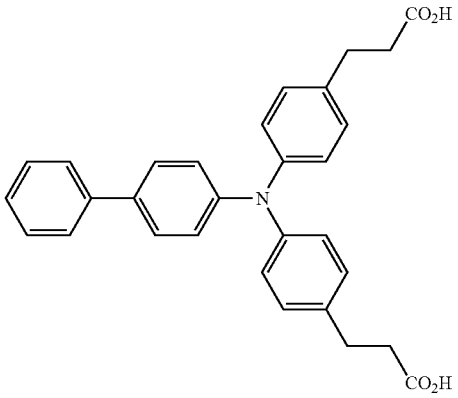

-continued
I-24
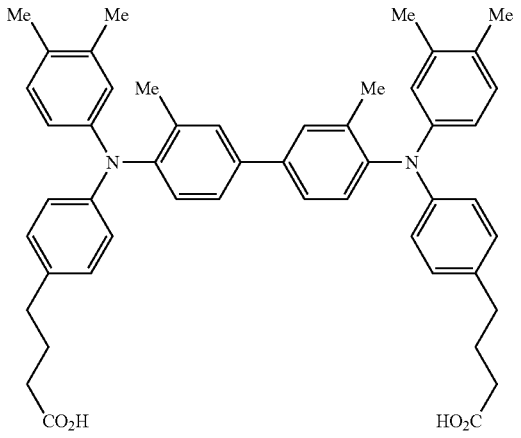
I-25
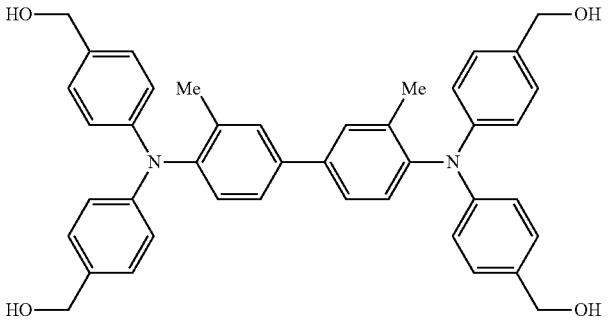
I-26
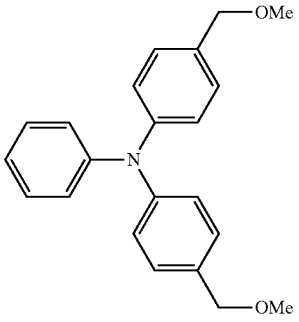
I-27
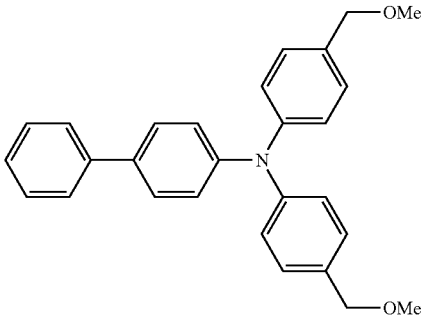

-continued

I-28

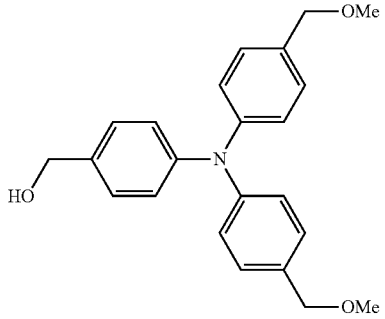

I-29

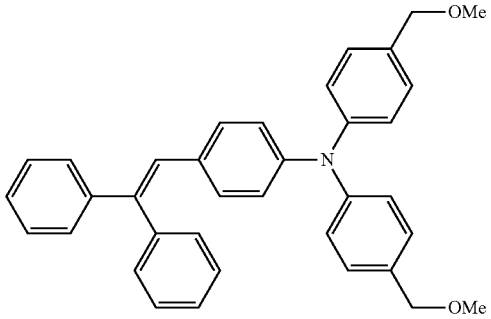

I-30

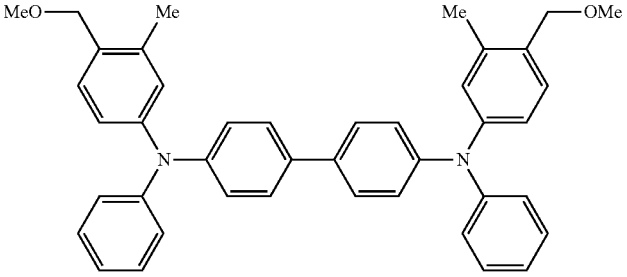

I-31

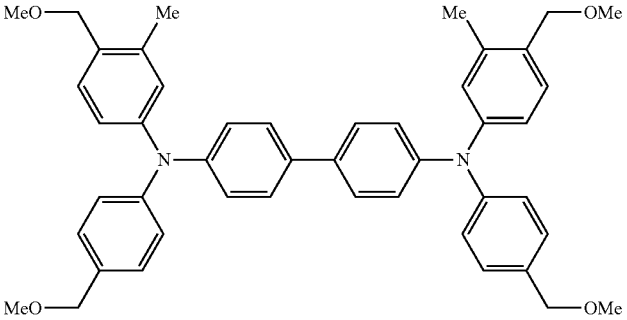

(B) Fluorinated Resin Particles

The protective layer 5 according to the first exemplary embodiment further contains fluorinated resin particles.

The fluorinated resin particles are not particularly limited, but may be one or two or more kinds selected from a tetrafluoroethylene resin (PTFE), a trifluorochloroethylene resin, a hexafluoropropylene resin, a fluorinated vinyl resin, a fluorinated vinylidene resin, a difluorodichloroethylene resin, and copolymers thereof. A tetrafluoroethylene resin or a fluorinated vinylidene resin is preferred, and a tetrafluoroethylene resin is particularly preferred.

The fluorinated resin particles preferably have an average primary particle diameter from 0.05 μm to 1 μm, and more preferably 0.1 μm to 0.5 μm.

The average primary particle diameter of the fluorinated resin particles is a value measured using a laser diffraction type particle size distribution measurement device LA-920 (trade name, manufactured by Horiba, Ltd.) at a refractive index of 1.35, using a measurement liquid obtained by diluting a dispersion in which the fluorinated resin particles are dispersed with the same solvent.

The content of the fluorinated resin particles is from 2% by weight to 10% by weight with respect to the total solid content of the protective layer 5 that is the surface protective layer.

(C) Other Compositions

In the protective layer 5, a crosslinked product formed by crosslinking at least one selected from the above-described guanamine compound and melamine compound and the specific charge transporting material may be used in combination with other thermosetting resins such as a phenol resin, a melamine resin, a urea resin, an alkyd resin, or a benzoguanamine resin. Furthermore, a compound having more functional groups in one molecule, such as a spiroacetal guanamine resin (for example "CTU-GUANAMINE" (trade name, manufactured by Ajinomoto-Fine-Techno Co., Inc.)) may be copolymerized with the material in the crosslinked product.

Furthermore, a surfactant may be added to the protective layer 5. Preferable examples of the surfactant to be used include surfactants including at least one or more structures selected from a fluorine atom, an alkylene oxide structure, and a silicone structure.

An antioxidant may be added to the protective layer 5. Examples of the antioxidant include hindered phenol antioxidants and hindered amine antioxidants, and known antioxidants such as an organic sulfur antioxidant, a phosphite antioxidant, a dithiocarbamate antioxidant, a thiourea antioxidant, or a benzimidazole antioxidant may be used. The content of the antioxidant to be added may be 20% by weight or less, and more preferably 10% by weight or less, based on the protective layer.

Examples of the hindered phenol antioxidants include 2,6-di-t-butyl-4-methylphenol, 2,5-di-t-butylhydroquinone, N,N-hexamethylene bis(3,5-di-t-butyl-4-hydroxy-hydrocinnamide, 3,5-di-t-butyl-4-hydroxy-benzylphosphonate-diethylester, 2,4-bis[(octylthio)methyl]-o-cresol, 2,6-di-t-butyl-4-ethylphenol, 2,2'-methylenebis(4-methyl-6-t-butylphenol), 2,2'-methylenebis(4-ethyl-6-t-butylphenol), 4,4'-butylidenebis(3-methyl-6-t-butylphenol), 2,5-di-t-amythydroquinone, 2-t-butyl-6-(3-butyl-2-hydroxy-5-methylbenzyl)-4-methylphenyl acrylate, and 4,4'-butylidenebis (3-methyl-6-t-butylphenol).

The protective layer 5 may include a curing catalyst for accelerating curing of the guanamine compound and melamine compound or the specific charge transporting material. As the curing catalyst, an acid catalyst may be used. Examples of the acid catalyst include aliphatic carboxylic acids such as acetic acid, chloroacetic acid, trichloroacetic acid, trifluoroacetic acid, oxalic acid, maleic acid, malonic acid, or lactic acid; aromatic carboxylic acids such as benzoic acid, phthalic acid, terephthalic acid, or trimellitic acid; and aliphatic or aromatic sulfonic acids such as methanesulfonic acid, dodecylsulfonic acid, benzenesulfonic acid, dodecylbenzenesulfonic acid, or naphthalenesulfonic acid. A sulfur-containing material is preferably used.

The sulfur-containing material to be used as the curing catalyst may be a material that is acidic at normal temperature (for example, at 25° C.) or after heating, and is preferably at least one of an organic sulfonic acid and a derivative thereof. The presence of the catalyst in the protective layer 5 may be readily detected by Energy Dispersive X-ray Spectroscopy (EDS), X-ray Photoelectron Spectroscopy (XPS), or the like.

Examples of the organic sulfonic acid and/or the derivative thereof include paratoluenesulfonic acid, dinonylnaphthalenesulfonic acid (DNNSA), dinonylnaphthalenedisulfonic acid (DNNDSA), dodecylbenzenesulfonic acid, and phenolsulfonic acid. Among these, most preferred are paratoluenesulfonic acid and dodecylbenzenesulfonic acid. The salts of the organic sulfonates may also be used, as long as they are capable of dissociating in the curable resin composition.

Further, a so-called heat latent catalyst, which exhibits an increased catalytic activity when heat is applied thereto, may be used.

Examples of the heat latent catalyst include microcapsules in which an organic sulfone compound or the like is coated with a polymer in the form of particles, porous compounds such as zeolite onto which an acid is adsorbed, heat latent protonic acid catalysts in which a protonic acid and/or a derivative thereof are blocked with a base, a protonic acid and/or a derivative thereof esterified by a primary or secondary alcohol, a protonic acid and/or a derivative thereof blocked with a vinyl ether and/or a vinyl thioether, monoethyl amine complexes of boron trifluoride, and pyridine complexes of boron trifluoride.

Among these, those in which a protonic acid and/or a derivative thereof is blocked with a base are preferred.

Examples of the protonic acid of the heat latent protonic acid catalyst include sulfuric acid, hydrochloric acid, acetic acid, formic acid, nitric acid, phosphoric acid, sulfonic acid, monocarboxylic acids, polycarboxylic acids, propionic acid, oxalic acid, benzoic acid, acrylic acid, methacrylic acid, itaconic acid, phthalic acid, maleic acid, benzene sulfonic acid, o-toluenesulfonic acid, m-toluenesulfonic acid, p-toluenesulfonic acid, styrenesulfonic acid, dinonylnaphthalenesulfonic acid, dinonylnaphthalenedisulfonic acid, decylbenzenesulfonic acid, undecylbenzenesulfonic acid, tridecylbenzenesulfonic acid, tetradecylbenzenesulfonic acid, and dodecylbenzenesulfonic acid. Examples of the protonic acid derivatives include neutralized alkali metal salts, alkali earth metal salts, or the like of protonic acids such as sulfonic acid or phosphoric acid, and polymer compounds in which a protonic acid backbone is incorporated into a polymer chain (polyvinylsulfonic acids or the like). Examples of the base to block the protonic acid include amines.

The amines are classified into primary, secondary, and tertiary amines. Any of these amines may be used without particular limitation.

Examples of the primary amines include methylamine, ethylamine, propylamine, isopropylamine, n-butylamine, isobutylamine, t-butylamine, hexylamine, 2-ethylhexylamine, secondary butylamine, allylamine, and methylhexylamine.

Examples of the secondary amines include dimethylamine, diethylamine, di-n-propylamine, diisopropylamine, di-n-butyl amine, diisobutyl amine, di-t-butylamine, dihexylamine, di(2-ethylhexyl)amine, N-isopropyl N-isobutylamine, di(2-ethylhexyl)amine, di-secondary-butylamine, diallylamine, N-methylhexylamine, 3-pipecoline, 4-pipecoline, 2,4-lupetidine, 2,6-lupetidine, 3,5-lupetidine, morpholine, and N-methylbenzylamine.

Examples of the tertiary amines include trimethylamine, triethylamine, tri-n-propylamine, triisopropylamine, tri-n-butylamine, triisobutylamine, tri-t-butylamine, trihexylamine, tri(2-ethylhexyl)amine, N-methyl morpholine, N,N-dimethylallylamine, N-methyl diallylamine, triallylamine, N,N-dimethylallylamine, N,N,N',N'-tetramethyl-1,2-diaminoethane, N,N,N',N'-tetramethyl-1,3-diaminopropane, N,N,N',N'-tetraallyl-1,4-diaminobutane, N-methylpiperidine, pyridine, 4-ethylpyridine, N-propyldiallylamine, 3-dimethylaminopropanol, 2-ethylpyrazine, 2,3-dimethylpyrazine, 2,5-dimethylpyrazine, 2,4-lutidine, 2,5-lutidine, 3,4-lutidine, 3,5-lutidine, 2,4,6-collidine, 2-methyl-4-ethylpyridine, 2-methyl-5-ethylpyridine, N,N,N',N'-tetramethyl hexamethylenediamine, N-ethyl-3-hydroxypiperidine, 3-methyl-4-ethylpyridine, 3-ethyl-4-methylpyridine, 4-(5-nonyl)pyridine, imidazole, and N-methylpiperazine.

Examples of the commercially available products include "NACURE 2501" (toluenesulfonic acid dissociation, methanol/isopropanol solvent, pH of from 6.0 to 7.2, dissociation temperature 80° C.), "NACURE 2107" (p-toluenesulfonic acid dissociation, isopropanol solvent, pH of from 8.0 to 9.0, dissociation temperature 90° C.), "NACURE 2500" (p-toluenesulfonic acid dissociation, isopropanol solvent, pH of from 6.0 to 7.0, dissociation temperature 65° C.), "NACURE 2530" (p-toluenesulfonic acid dissociation, methanol/isopropanol solvent, pH of from 5.7 to 6.5, dissociation temperature 65° C.), "NACURE 2547" (p-toluenesulfonic acid dissociation, aqueous solution, pH of from 8.0 to 9.0, dissociation temperature 107° C.), "NACURE 2558" (p-toluene sulfonic acid dissociation, ethylene glycol solvent, pH of from 3.5 to 4.5, dissociation temperature 80° C.), "NACURE XP-357" (p-toluenesulfonic acid dissociation, methanol solvent, pH of from 2.0 to 4.0, dissociation temperature 65° C.), "NACURE XP-386" (p-toluenesulfonic acid dissociation, aqueous solution, pH of from 6.1 to 6.4, dissociation temperature 80° C.), "NACURE XC-2211" (p-toluenesulfonic acid dissociation, pH of from 7.2 to 8.5, dissociation temperature 80° C.), "NACURE 5225" (dodecylbenzenesulfonic acid dissociation, isopropanol solvent, pH of from 6.0 to 7.0, dissociation temperature 120° C.), "NACURE 5414" (dodecylbenzenesulfonic acid dissociation, xylene solvent, dissociation temperature 120° C.), "NACURE 5528" (dodecylbenzenesulfonic acid dissociation, isopropanol solvent, pH of from 7.0 to 8.0, dissociation temperature 120° C.), "NACURE 5925" (dodecylbenzenesulfonic acid dissociation, pH of from 7.0 to 7.5, dissociation temperature 130° C.), "NACURE 1323" (dinonyl naphthalene sulfonic acid dissociation, xylene solvent, pH of from 6.8 to 7.5, dissociation temperature 150° C.), "NACURE 1419" (dinonylnaphthalenesulfonic acid dissociation, xylene/methyl isobutyl ketone solvent, dissociation temperature 150° C.), "NACURE 1557" (dinonylnaphthalenesulfonic acid dissociation, butanol/2-butoxyethanol solvent, pH of from 6.5 to 7.5, dissociation temperature 150° C.), "NACURE X49-110" (dinonylnaphthalene disulfonic acid dissociation, isobutanol/isopropanol solvent, pH of from 6.5 to 7.5, dissociation temperature 90° C.), "NACURE 3525" (dinonylnaphthalene disulfonic acid dissociation, isobutanol/isopropanol solvent, pH of from 7.0 to 8.5, dissociation temperature 120° C.), "NACURE XP-383" (dinonylnaphthalene disulfonic acid dissociation, xylene solvent, dissociation temperature 120° C.), "NACURE 3327" (dinonylnaphthalene disulfonic acid dissociation, butanol/isopropanol solvent, pH of from 6.5 to 7.5, dissociation temperature 150° C.), "NACURE 4167" (phosphoric acid dissociation, isopropanol/isobutanol solvent, pH of from 6.8 to 7.3, dissociation temperature 80° C.), "NACURE XP-297" (phosphoric acid dissociation, water/isopropanol solvent, pH of from 6.5 to 7.5, dissociation temperature 90° C.), and "NACURE 4575" (phosphoric acid dissociation, pH of from 7.0 to 8.0, dissociation temperature 110° C.) (trade names, all manufactured by King Industries).

These heat latent catalysts may be used alone or in combination of two or more kinds thereof.

Herein, the blending amount of the catalyst is preferably in the range from 0.1% by weight to 10% by weight, and particularly preferably from 0.1% by weight to 5% by weight, with respect to the total solid content in the coating liquid, excluding the fluorinated resin particles and the fluorinated alkyl group-containing copolymers.

Method for Forming Protective Layer

Herein, the method for producing a photoreceptor according to an exemplary embodiment of the invention may be a production method including the following processes, as described above:

a coating liquid preparation process of preparing a coating liquid for forming a surface protective layer, in which the coating liquid contains a crosslinked product of a compound having a guanamine structure or a melamine structure with a compound containing a charge transporting material having at least one substituent selected from —OH, —$OCH_3$, —$NH_2$, —SH and —COOH, and fluorinated resin particles, and has a viscosity of from 10 mPa·s to 60 mPa·s, the content of the charge transporting material after drying is from 90% by weight to 98% by weight, and the content of the fluorinated resin particles after drying is from 2% by weight to 10% by weight;

a coating liquid ejection process in which the coating liquid is jetted in the form of liquid droplets having a size from 1 pl to 20 pl onto a photosensitive layer, on a substrate having at least the photosensitive layer thereon, from an inkjet liquid droplet ejection head to form a coating film; and a drying process in which the coating film is dried to form a surface protective layer.

For the coating liquid for forming a protective layer, at least one kind of solvents may be used alone or as a mixture. As the solvent used for forming the protective layer 5, cyclic aliphatic ketone compounds such as cyclobutanone, cyclopetanone, cyclohexanone, or cycloheptanone may be used. Other than the aliphatic cyclic ketone compounds, examples of the solvent include cyclic or linear alcohols such as methanol, ethanol, propanol, butanol, or cyclopentanol; linear ketones such as acetone or methyl ethyl ketone; cyclic or linear ethers such as tetrahydrofuran, dioxane, ethylene glycol, or diethyl ether; and halogenated aliphatic hydrocarbon solvents such as methylene chloride, chloroform, or ethylene chloride.

The amount of the solvent is not particularly limited, but it may be from 0.5 parts by weight to 30 parts by weight, and more preferably from 1 part by weight to 20 parts by weight, based on 1 part by weight of the guanamine compound and/or the melamine compound.

After coating, the resultant coating film is cured (or crosslinked) by heating, for example, to a temperature from 100° C. to 170° C., whereby the protective layer 5 is obtained.

Process Cartridge and Image Forming Apparatus

Next, a process cartridge and an image forming apparatus, including the electrophotographic photoreceptor of an exemplary embodiment of the invention, will be described.

The process cartridge of the invention is not particularly limited as long as it has at least the electrophotographic photoreceptor of the invention. Specifically, the process cartridge may have a configuration including: the electrophotographic photoreceptor according to the exemplary embodiments of the invention as a latent image holder; and at least one selected from a charging device, a developing device and a cleaning device, and may be attachable to or detachable from an image forming apparatus in which a toner image obtained by developing an electrostatic latent image on the surface of the latent image support is transferred to a recording medium, to form an image on the recording medium.

The image forming apparatus of the present invention is not particularly limited as long as it has at least the electrophotographic photoreceptor of the invention. Specifically, the image forming apparatus may have a configuration including: the electrophotographic photoreceptor according to the exemplary embodiments of the invention; a charging device that charges the electrophotographic photoreceptor; a latent image forming device that forms an electrostatic latent image on the surface of the electrophotographic photoreceptor; a developing device that develops the electrostatic latent image formed on the surface of the electrophotographic photoreceptor using a toner to form a toner image; and a transfer device that transfers the toner image formed on the surface of the electrophotographic photoreceptor onto a recording medium. In an exemplary embodiment, the image forming apparatus may be a tandem device having plural photoreceptors corresponding to toners for respective colors, and in this case, all the photoreceptors are preferably the electrophotographic photoreceptors of the invention. The transfer of the toner image may be carried out in an intermediate transfer mode using an intermediate transfer body.

Figure 3:
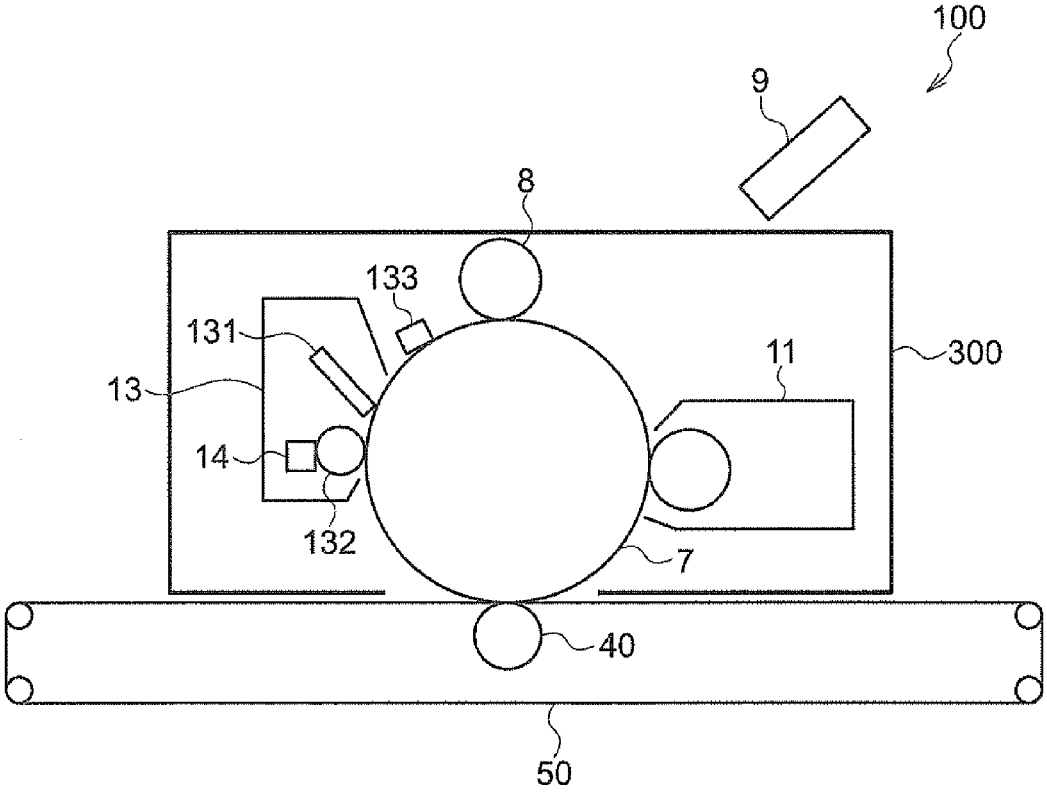
FIG. 3 is a schematic constitutional view showing an image forming apparatus according to an exemplary embodiment of the present invention.

FIG. 3 is a schematic configurational diagram showing an image forming apparatus according to an exemplary embodiment of the invention. As shown in FIG. 3, the image forming apparatus 100 includes a process cartridge 300 having an electrophotographic photoreceptor 7, an exposure device 9, a transfer device 40, and an intermediate transfer body 50. In the image forming apparatus 100, the exposure device 9 is arranged so as to enable exposure of the electrophotographic photoreceptor 7 through an opening of the process cartridge 300, the transfer device 40 is arranged so as to face the electrophotographic photoreceptor 7 via the intermediate transfer body 50, and the intermediate transfer body 50 is arranged so as to partially contact with the electrophotographic photoreceptor 7.

The process cartridge 300 in the FIG. 3 integrally supports the electrophotographic photoreceptor 7, a charging device 8, a developing device 11 and a cleaning device 13, in a housing. The cleaning device 13 has a cleaning blade (i.e., cleaning member). The cleaning blade 131 is disposed so as to contact the surface of the electrophotographic photoreceptor 7.

FIG. 3 shows an exemplary embodiment in which a fibrous member 132 (roll-shaped member) that supplies a lubricant 14 to the surface of the photoreceptor 7, and a fibrous member 133 (flat brush-shaped member) that assists cleaning are used. However, in exemplary embodiments, these members may be used or may not used.

As the charging device 8, for example, a contact type charging device using a conductive or semiconductive charging roller, a charging brush, a charging film, a charging rubber blade, a charging tube, or the like may be used. Known charging devices such as a non-contact type roller charging device, or a scorotron or corotron charging device using corona discharge, may also be used.

Although not shown, a photoreceptor heating member may be provided around the electrophotographic photoreceptor 7 so as to increase the temperature of the electrophotographic photoreceptor 7 and reduce the relative temperature.

Examples of the exposure device 9 include optical instruments which can subject the surface of the photoreceptor 7 to image-wise exposure of a desired image of semiconductor laser light, LED light, liquid-crystal shutter light, or the like. The wavelength of light sources to be used is in the range of the spectral sensitivity region of the photoreceptor. As the semiconductor laser light, near-infrared light having an oscillation wavelength in the vicinity of 780 nm is predominantly used. However, the wavelength of the light source is not limited to the above-described wavelength, and lasers having an oscillation wavelength on the order of 600 nm and blue lasers having an oscillation wavelength in the vicinity from 400 nm to 450 nm may also be used. Surface-emitting laser light sources which are capable of multi-beam output may also be useful to form a color image.

As the developing device 11, for example, a common developing device, in which a magnetic or non-magnetic one- or two-component developer, or the like is contacted or not contacted for forming an image, may be used. Such a developing device is not particularly limited as long as it has above-described functions, and may be appropriately selected according to the purposes. Examples thereof include known developing devices in which the one- or two-component developer is applied to the photoreceptor 7 using a brush, a roller, or the like. Among these, a development roller is preferably used, in which a developer is kept on the surface.

Hereinbelow, a toner to be used in the developing device 11 will be described.

The toner used in the image forming apparatus of the present invention may have an average shape factor (i.e., $(ML^2/A)\times(\pi/4)\times100$, wherein ML represents the maximum length of a particle and A represents the projection area of the particle) of from 100 to 150, more preferably from 105 to 145, and further preferably from 110 to 140. Furthermore, the volume-average particle diameter of the toner particles may be from 3 μm to 12 μm, and more preferably 3.5 μm to 9 μm.

The toner is not limited by the preparation method thereof. For example, a toner prepared by a kneading and pulverizing method in which a binder resin, a colorant, a releasing agent and further a charge control agent or the like are kneaded, pulverized and classified, a toner prepared by a method of changing the shape of particles obtained by the kneading and pulverizing method by applying a mechanical impact or thermal energy, a toner prepared by an emulsion polymerizing aggregating method in which a dispersion obtained by emulsion-polymerizing polymerizable monomers of a binder resin is mixed with a dispersion of a colorant, a releasing agent, and further a charge control agent or the like, and the mixture is aggregated and heat-fused to obtain toner particles, a toner prepared by a suspension polymerization method in which polymerizable monomers for obtaining a binder resin, and a solution of a colorant, a releasing agent, and further a charge control agent are suspended in an aqueous medium, a toner prepared by a dissolution suspension method in which a binder resin, and a solution containing a colorant, a releasing agent, and further a charge control agent or the like are suspended and polymerized in an aqueous medium, and performing granulation, or the like may be used.

In addition, known methods such as a preparation method by which toner of a core-shell structure is formed using the toner obtained by the method as detailed above as core, making aggregating particles adhere to the core and fusing them by heating may be employed. From the viewpoints of shape control and particle-size distribution control, a suspension polymerization method in which the preparation is carried out using an aqueous solvent, an emulsion polymerization aggregation method, or a dissolution suspension method is preferred, and an emulsion polymerization aggregation method is particularly preferred.

The toner mother particle preferably contains a binder resin, a colorant, and a release agent, and it may further contain silica or a charge control agent.

Examples of the binder resin used in the toner mother particle include homopolymers or copolymers of styrene compounds such as styrene or chlorostyrene, monoolefins such as ethylene, propylene, butylene, or isoprene, vinyl esters such as vinyl acetate, vinyl propionate, vinyl benzoate, or vinyl butyrate, α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, or dodecyl methacrylate, vinyl ethers such as vinyl methyl ether, vinyl ethyl ether, or vinyl butyl ether, and vinyl ketones such as vinyl methyl ketone, vinyl hexyl ketone, or vinyl isopropenyl ketone, and polyester resins formed by copolymerization of dicarboxylic acids and diols.

Particularly typical examples of the binder resin include a polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene, polypropylene, and a polyester resin. Further examples of the binder resin include a polyurethane, an epoxy resin, a silicone resin, a polyamide, a modified rosin, and a paraffin wax.

Typical examples of the colorant include magnetic powders such as magnetite or ferrite, carbon black, aniline blue, calco oil blue, chrome yellow, ultramarine blue, Du Pont oil red, quinoline yellow, methylene blue chloride, phthalocyanine blue, malachite green oxalate, lamp black, Rose Bengal, C. I. Pigment Red 48:1, C. I. Pigment Red 122, C. I. Pigment Red 57:1, C. I. Pigment Yellow 97, C. I. Pigment Yellow 17, C. I. Pigment Blue 15:1, and C. I. Pigment Blue 15:3.

Typical examples of the release agents include low-molecular-weight polyethylene, low-molecular-weight polypropylene, Fischer-Tropusch wax, montan wax, carnauba wax, rice wax, and candelilla wax.

As the electrification control agent, any known electrification control agent may be used, but specifically, an azo-metal complex compound, a salicylic acid-metal complex compound, or a polar group-containing resin type charge control agent may be used. When the toner is prepared by a wet preparation method, a material which has a poor water solubility is preferably used. In addition, the toner may be either a magnetic toner containing a magnetic material, or a non-magnetic toner which contains no magnetic material.

The toner used in the developing device 11 may be prepared by mixing the mother particles of toner and the external additives by means of a Henschel mixer, a V-blender, or the like. Alternatively, the external additives may be added in a wet method when the mother particles of the toner are prepared in a wet method.

To the toner used in the developing device 11, lubricative particles may be added. Examples of lubricative particles usable therein include solid lubricants such as graphite, molybdenum disulfide, talc, fatty acids, or metal salts of fatty acids, low-molecular-weight polyolefins such as polypropylene, polyethylene, or polybutene, silicones that softenes by heating, aliphatic amides such as oleic amide, erucic amide, ricinoleic amide, or stearic amide, vegetable wax such as carnauba wax, rice wax, candelilla wax, Japan wax, or jojoba oil, animal wax such as beeswax, mineral or petroleum wax such as montan wax, ozokerite, ceresin, paraffin wax, microcrystalline wax, or Fischer-Tropusch wax, and modified products of the waxes described above. The lubricants may be used alone or in combination with two or more kinds thereof. However, it is preferable that such wax has an average particle size of 0.1 μm to 10 μm, so wax with the same chemical structure as the wax material as described above may be pulverized into particles of a uniform size. The amount of the wax added to the toner is preferably from 0.05% by weight to 2.0% by weight, and more preferably from 0.1% by weight to 1.5% by weight, with respect to the total weight of the toner.

To the toner used in the developing device 11, inorganic particles, organic particles, composite particles formed by making inorganic particles adhere to organic particles, or the like may be added.

Examples of the inorganic particles include various kinds of inorganic oxides, nitrides, and borides, such as silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride, or boron nitride.

The inorganic particles may be treated with a titanate coupling agent such as tetrabutyl titanate, tetraoctyl titanate, isopropyltriisostearoyl titanate, isopropyltridecylbenzenesulfonyl titanate, or bis(dioctylpyrophosphate)oxyacetate titanate, or a silane coupling agent such as γ-(2-aminoethyl)aminopropyltrimethoxysilane, γ-(2-aminoethyl)aminopropylmethyldimethoxysilane, γ-methacryloxypropyltrimethoxysilane, N-β-(N-vinylbenzylaminoethyl)-γ-aminopropyltrimethoxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane, or p-methylphenyltrimethoxysilane. In addition, inorganic particles rendered hydrophobic by treatment with a metal salt of higher fatty acid such as silicone oil, aluminum stearate, zinc stearate, or calcium stearate are also preferably used.

Examples of the organic particles include styrene resin particles, styrene-acrylic resin particles, polyester resin particles, and urethane resin particles.

As for the particle diameter, the number average particle diameter of the inorganic particles, organic particles, or composite particles is preferably from 5 nm to 1000 nm, more preferably from 5 nm to 800 nm, and further preferably from 5 nm to 700 nm. Further, the sum of the addition amounts of the above-described particles and the slipping particles is preferably 0.6% by weight or more.

As other inorganic oxides added to the toner, it is preferable to use small-diameter inorganic oxides having a primary particle size of 40 nm or less, and further to use larger-diameter inorganic oxides. These inorganic oxide particles may be any of known ones, but combined use of silica and titanium oxide is preferable.

In addition, small-diameter inorganic particles may be subjected to a surface treatment. Further, it is also preferable to add carbonates such as calcium carbonate or magnesium carbonate, or inorganic minerals such as hydrotalcite.

The electrophotographic color toner is mixed with a carrier and then used. As the carrier, iron powder, glass beads, ferrite powder, nickel powder, or these metal powders in which surfaces of which are coated with resins may be used. The mixing ratio between the toner and the carrier may be determined arbitrary.

Examples of the transfer device 40 include per-se known transfer charging devices such as a contact type transfer charging devices using a belt, a roller, a film, a rubber blade, a scorotron transfer charging device, and a corotron transfer charging device utilizing corona discharge.

As the intermediate transfer body 50, a belt (intermediate transfer belt) which is imparted with semiconductivity of polyimide, polyamide imide, polycarbonate, polyarylate, polyester, rubber, or the like may be used. Alternatively, the intermediate transfer body 50 to be used may have a drum form, other than the belt form.

In addition to the above-described devices, the image forming apparatus 100 may further be provided with, for example, an optical neutralization device that subjects the photoreceptor 7 to optical neutralization.

Figure 4:
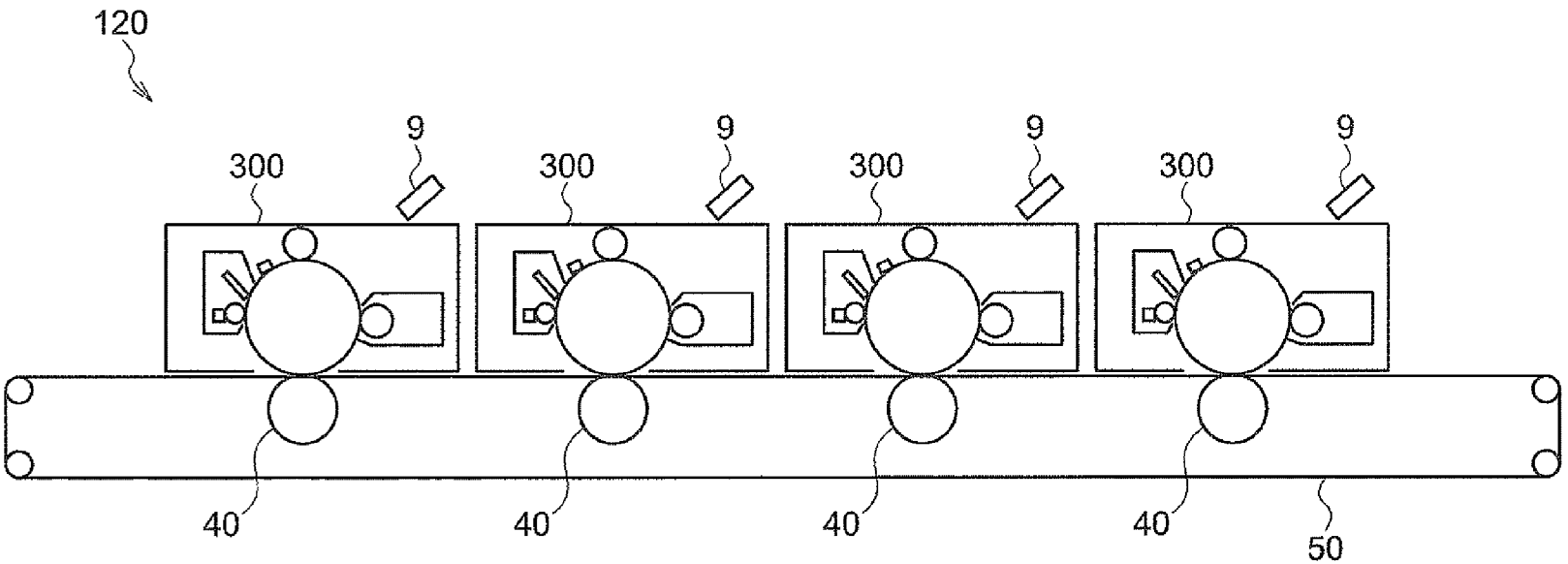
FIG. 4 is a schematic constitutional view showing an image forming apparatus according to another exemplary embodiment of the present invention.

FIG. 4 is a schematic cross-sectional view showing an image forming apparatus according to another embodiment. As shown in FIG. 4, the image forming apparatus 120 is a full color image forming apparatus of tandem type, including four process cartridges 300. In the image forming apparatus 120, four process cartridges 300 are disposed parallel with each other on the intermediate transfer body 50, and one electrophotographic photoreceptor is used for one color. The image forming apparatus 120 has the same configuration as that of the image forming apparatus 100, except for being a tandem type.

In the image forming apparatus (or process cartridge) according to exemplary embodiments of the invention, the developing device may have a developing roller as a developer holding member, the roller being moved (rotated) in the reverse direction to the moving direction (rotating direction) of the electrophotographic receptor. Here, the development roller has a cylindrical development sleeve for holding a developer on the surface of the development roller, and the developing device may have a structure having a regulating member for regulating the quantity of the developer to be supplied to the development sleeve. By moving (rotating) the development roller of the developing device in the direction opposite to the rotating direction of the electrophotographic receptor, the surface of the electrophotographic receptor is rubbed with the toner remaining between the development roller and the electrophotographic receptor.

Further, in the image forming apparatus of the present embodiment, the gap between the development sleeve and the photoreceptor is preferably from 200 μm to 600 μm, and more preferably from 300 μm to 500 μm. Furthermore, from the similar viewpoints, the gap between the development sleeve and the regulating blade that regulates the quantity of the developer is preferably from 300 μm to 1,000 μm, and more preferably from 400 μm to 750 μm.

Moreover, the absolute value of the moving velocity of the surface of the development roller is preferably from 1.5 times to 2.5 times the absolute value of the moving velocity (process speed) of the surface of the photoreceptor, and more preferably from 1.7 times to 2.0 times the absolute value of the moving velocity of the surface of the photoreceptor.

In the image forming apparatus (or process cartridge) according to an exemplary embodiment of the invention, the development device (development unit) is preferably a device which includes a developer holding member having a magnetic substance, and develops an electrostatic latent image with a two-component developer containing a magnetic carrier and a toner.

EXAMPLES

Hereinafter, the present invention will be described in detail with reference to Examples and Comparative Examples, but is not limited to the following Examples.

Example 1

Formation of Undercoat Layer

First, 100 parts by weight of zinc oxide (average particle diameter: 70 nm, specific surface area: 15 $m^2/g$, manufactured by Tayca Corporation), and 500 parts by weight of tetrahydrofuran are mixed by stirring, 1.25 parts by weight of KBM603 (trade name, manufactured by Shin-Etsu Chemical) as a silane coupling agent is added thereto, and the mixture is stirred for 2 hours. Then, tetrahydrofuran is distilled off by distillation under reduced pressure, and the residue is baked at 120° C. for 3 hours, thereby obtaining silane coupling agent-surface modified zinc oxide particles.

Next, 38 parts by weight of a solution obtained by dissolving 60 parts by weight of the surface-treated zinc oxide particles, 0.6 part by weight of alizarin, 13.5 parts by weight of a curing agent of a blocked isocyanate (SUMIDUR 3173, trade name, manufactured by Sumitomo Bayer Urethane Co., Ltd.), and 15 parts by weight of a butyral resin (S-LEC BM-1, trade name, manufactured by Sekisui Chemical Co., Ltd.) in 85 parts by weight of methylethylketone, and 25 parts by weight of methyl ethyl ketone are mixed and dispersed with a sand mill using a glass bead having a diameter of 1 mm for 4 hours, thereby obtaining a dispersion.

To the dispersion thus obtained, 0.005 part by weight of dioctyltin dilaurate as a catalyst and 4.0 parts by weight of silicone resin particles (TOSPEARL 145, trade name, manufactured by GE Toshiba Silicones Co., Ltd.) are added, thereby obtaining a coating liquid for an undercoat layer.

The coating liquid is applied on an aluminum substrate having a diameter of 30 mm by a dip coating method, and then dried and cured at 180° C. for 40 min., thereby forming an undercoat layer having a thickness of 25 p.m.

Formation of Charge Generating Layer

Then, a mixture of 15 parts by weight of a charge generating substance of chlorogallium phthalocyanine having diffraction peaks at Bragg angles (2θ±0.2°) of at least 7.4°, 16.6°, 25.5°, and 28.3°, as determined by an X-ray diffraction spectrum obtained by using a Cukα ray, 10 parts by weight of a copolymer resin of vinyl chloride-vinyl acetate (VMCH, trade name, manufactured by Nippon Unicar Co., Ltd.), and 300 parts by weight of n-butyl alcohol is dispersed in a sand mill using a glass bead having a diameter of 1 mm for 4 hours, thereby obtaining a dispersion for forming a charge generating layer.

The dispersion for forming a charge generating layer is applied over the undercoat layer by dip coating, and dried at 120° C. for 5 minutes, thereby forming a charge generating layer having a thickness of 0.2 μm.

Formation of Charge Transporting Layer

Next, 42 parts by weight of N,N-bis(3-methylphenyl)-N, N-diphenylbenzidine and 58 parts by weight of a bisphenol Z polycarbonate resin (trade name: TS2050, viscosity average molecular weight 50,000, manufactured by Teijin Chemicals Ltd.) are sufficiently dissolved and mixed in 280 parts by weight of tetrahydrofuran and 120 parts by weight of toluene, thereby obtaining a coating liquid for forming a charge transporting layer.

The coating liquid for forming a charge transporting layer is applied on the aluminum support having the charge generating layer by dip coating, and dried at 135° C. for 40 minutes, thereby forming a charge transporting layer having a film thickness of 20 pa.

Formation of Protective Layer

Next, a mixed solution of 0.5 parts by weight of a fluorinated comb-type graft polymer (GF300, trade name, manufactured by Toagosei Co., Ltd.), 10 parts by weight of polytetrafluoroethylene particles (LUBRON L-2, trade name, manufactured by Daikin Industries Ltd.), and 20 parts by weight of cyclopetanone is mixed into a solution in which 70 parts by weight of the compound (I-10), 70 parts by weight of the compound (I-25), and 2 parts by weight of melamine having the structure shown below are dissolved in 200 parts by weight of cyclopetanone (as a solvent), and subjected to a dispersion treatment using a collision type high-pressure dispersing machine (NANOMIZER, trade name, manufactured by Yoshida Kikai Co., Ltd.). The resultant solution is mixed with 0.05 parts by weight of a block sulfonic acid (NACURE 5225, trade name, manufactured by King Industries Inc.), thereby preparing a coating liquid for forming a protective layer. The viscosity of the coating liquid for a protective layer is measured, and found to be 13 mPa·s.

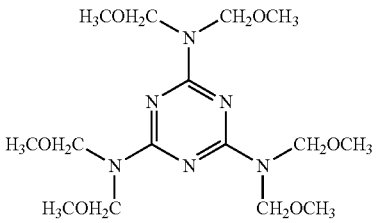

The obtained coating liquid for a protective layer is applied on the aluminum support having the charge transporting layer by ink jetting, and dried at 150° C. for 40 minutes, thereby forming a protective layer having a film thickness of 5 μm.

For the liquid droplet ejection head used for forming the protective layer, a piezo intermittent head PIXELJET 64 (trade name, manufactured by Trident Co.) having nozzles in 32×2 columns, is used, and 20 nozzles in one column, among the 64 nozzles of the liquid droplet ejection head are used. The frequency of the jet in the coating liquid is set to 2.5 kHz of injection and the liquid droplet ejection head is provided at a tilt angle of 85° relative to a cylindrical support with a distance between the liquid droplet ejection head and the aluminum support formed up to the charge transport layer of 10 mm.

In addition, the axis of the aluminum support is provided to be horizontal and while rotating the aluminum support at 200 rpm, coating is carried out when an average scanning speed of the liquid droplet ejection head in the axial direction is set to 261 mm/min, and the size (volume) of the liquid droplet from the nozzle is 5 pl. In addition, the particle diameter of the liquid droplet is measured by off-line visualization evaluation. An LED is lighted toward the liquid droplets on the jet timing, and the image is observed by means of a CCD camera.

Measurement of b/a

For the obtained photoreceptor, the value of [b/a] is calculated by means of EDS. Specifically, the protective layer and under layers thereof are peeled from the obtained photoreceptor, and the small pieces thereof are taken and embedded and cured in an epoxy resin, from which a section is prepared by microtome and taken as a sample for measurement. Using JSM-6700F/JED-2300F (trade names, manufactured by JEOL Ltd.) as an EDS device, the ratios of the fluorine atoms to the sum of the carbon atoms, oxygen atoms, and fluorine atoms present in a region of the surface protective layer ranging from the photosensitive layer side surface of the surface protective layer to a point corresponding to ⅔ of the film thickness of the surface protective layer are measured at an interval of 5 μm, and the average ratio thereof is taken as "a". Further, the ratios of the fluorine atoms to the sum of the carbon atoms, the oxygen atoms, and the fluorine atoms present in a region of the surface protective layer ranging from the outer surface to a point corresponding to ⅓ of the film thickness of the surface protective layer are measured at an interval of 5 and the average ratio thereof is taken as "b". From the obtained values of "a" and "b", a ratio "b/a" is calculated. The results are shown in Table 1.

Evaluation Test: Evaluation of Transfer Efficiency

The weights of the toner transferred before and after the abrasion of the obtained photoreceptor are measured, and evaluation of the transfer efficiency is carried out.

In order to measure the transfer efficiency of the surface protective layer, the obtained photoreceptor is mounted on PRINTER DOCUCENTER C6550I (trade name, manufactured by Fuji Xerox Co., Ltd.), and subjected to an image forming test for forming an image having an image intensity of 5% on 100,000 sheets of A4 paper under an environment of a normal temperature and normal humidity of 25° C. and 50%. Before the image formation test (initial) and after the image formation test (after abrasion), the weight of the toner in the toner image formed on the photoreceptor surface and the weight of the toner transferred from the photoreceptor surface onto the A4 paper are measured, and the transfer efficiency is calculated. The results are shown in Table 1.

Example 2

An electrophotographic photoreceptor is prepared in the same manner as in Example 1 except that the size (volume) of the liquid droplet from the nozzle is changed to 8 pl.

Example 3

An electrophotographic photoreceptor is prepared in the same manner as in Example 1 except that the size (volume) of the liquid droplet from the nozzle is changed to 10 pl.

Example 4

An electrophotographic photoreceptor is prepared in the same manner as in Example 1 except that the size (volume) of the liquid droplet from the nozzle is changed to 20 pl.

Example 5

An electrophotographic photoreceptor is prepared in the same manner as in Example 1 except that the solvent used for forming the coating liquid for a protective layer in Example 1, i.e., "200 parts by weight of cyclopetanone (as a solvent)", is changed to "150 parts by weight of cyclopetanone and 50 parts by weight of cyclopentanol".

Example 6

An electrophotographic photoreceptor is prepared in the same manner as in Example 1 except that the solvent used for forming the coating liquid for a protective layer in Example 1, i.e., "200 parts by weight of cyclopetanone (as a solvent)" is changed to "150 parts by weight of cyclopetanone and 50 parts by weight of cyclopentanol", and the size (volume) of the liquid droplet from the nozzle during coating is changed to 20 pl.

Example 7

An undercoat layer, a charge generating layer, and a charge transporting layer are formed on an aluminum support in the same manner as in Example 1.

Formation of Protective Layer

A mixed solution of 0.5 parts by weight of a fluorinated comb-type graft polymer (GF300, trade name, manufactured by Toagosei Co., Ltd.), 10 parts by weight of polytetrafluoroethylene particles (LUBRON L-2, trade name, manufactured by Daikin Industries Ltd.), and 20 parts by weight of cyclopetanone is mixed into a solution obtained by dissolving 125 parts by weight of a compound represented by the following Structural Formula (1) (acrylic resin) in 40 parts by weight of isopropyl alcohol and 160 parts by weight of cyclopentanol. The resultant mixture is subjected to a dispersion treatment using a collision type high-pressure dispersing machine (NANOMIZER, trade name, manufactured by Yoshida Kikai Co., Ltd.). Further, 0.01 parts by weight of a thermal polymerization initiator (OTAZO-15, trade name, manufactured by Otsuka Chemical Co., Ltd.) is added thereto, thereby preparing a coating liquid for forming a protective layer.

The obtained coating liquid for forming a protective layer is applied on the aluminum support having the charge generating layer by dip coating, and dried at 150° C. for 40 minutes, thereby forming a protective layer having a film thickness of 5 μm.

Structural Formula (1)

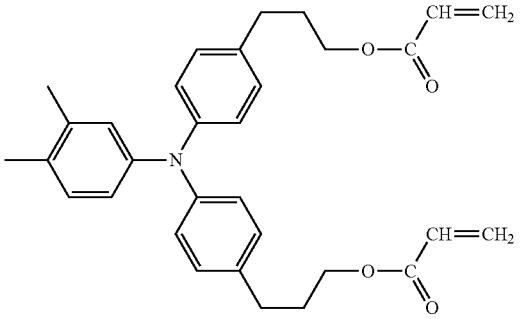

Example 8

An electrophotographic photoreceptor is prepared in the same manner as in Example 1 except that "2 parts by weight of melamine" used in Example 1 is changed to "5 parts by weight of melamine", and the size (volume) of the liquid droplet from the nozzle is changed to 8 pl.

Example 9

An electrophotographic photoreceptor is prepared in the same manner as in Example 1 except that "70 parts by weight of the compound (I-10) and 70 parts by weight of the compound (I-25)" are changed to "55 parts by weight of the compound (I-10) and 50 parts by weight of the compound (I-25)", "200 parts by weight of cyclopetanone (as a solvent)" is changed to "150 parts by weight of cyclopetanone (as a solvent)", and the size (volume) of the liquid droplet from the nozzle is changed to 8 pl.

Example 10

An electrophotographic photoreceptor is prepared in the same manner as in Example 1 except that: "70 parts by weight of the compound (I-10) and 70 parts by weight of the compound (I-25)" are changed to "55 parts by weight of the compound (I-10) and 50 parts by weight of the compound (I-25)"; "2 parts by weight of melamine" is changed to "4 parts by weight of melamine"; "200 parts by weight of cyclopetanone (as a solvent)" is changed to "150 parts by weight of cyclopetanone (as a solvent)"; "10 parts by weight of polytetrafluoroethylene particles (LUBRON L-2, trade name, manufactured by Daikin Industries Ltd.)" is changed to "2.5 parts by weight of polytetrafluoroethylene particles (LUBRON L-2, trade name, manufactured by Daikin Industries Ltd.)"; "0.5 parts by weight of a fluorinated comb-type graft polymer (GF300, trade name, manufactured by Toagosei Co., Ltd.)" is changed to "0.15 parts by weight of a fluorinated comb-type graft polymer (GF300, trade name, manufactured by Toagosei Co., Ltd.)"; and the size (volume) of the liquid droplet from the nozzle is changed to 8 pl.

Example 11

An electrophotographic photoreceptor is prepared in the same manner as in Example 1 except that: "2 parts by weight of melamine" is changed to "0 part by weight of melamine"; "10 parts by weight of polytetrafluoroethylene particles (LUBRON L-2, trade name, manufactured by Daikin Industries Ltd.)" is changed to "15 parts by weight of polytetrafluoroethylene particles (LUBRON L-2, trade name, manufactured by Daikin Industries Ltd.)"; and the size (volume) of the liquid droplet from the nozzle is changed to 8 pl.

Comparative Example 1

An electrophotographic photoreceptor is prepared in the same manner as in Example 1 except that the size (volume) of the liquid droplet from the nozzle is changed to 30 pl.

Comparative Example 2

An electrophotographic photoreceptor is prepared in the same manner as in Example 1 except that the method for applying the coating liquid for a protective layer in Example 1 is changed to dip coating.

Comparative Example 3

An electrophotographic photoreceptor is prepared in the same manner as in Example 1 except that the solvent used for forming the coating liquid for a protective layer in Example 1, i.e., "200 parts by weight of cyclopetanone (as a solvent)" is changed to "200 parts by weight of isopropyl alcohol", and the size (volume) of the liquid droplet from the nozzle is changed to 10 pl.

Comparative Example 4

An electrophotographic photoreceptor is prepared in the same manner as in Example 1 except that the solvent used for forming the coating liquid for a protective layer in Example 1, i.e., "200 parts by weight of cyclopetanone (as a solvent)" is changed to "200 parts by weight of cyclopentanol", and the size (volume) of the liquid droplet from the nozzle is changed to 10 pl.

Comparative Example 5

An electrophotographic photoreceptor is prepared in the same manner as in Example 1 except that the solvent used for forming the coating liquid for a protective layer in Example 1, i.e., "200 parts by weight of cyclopetanone (as a solvent)" is changed to "400 parts by weight of cyclopetanone".

Comparative Example 6

An electrophotographic photoreceptor is prepared in the same manner as in Example 7 except that the solvent used for fanning the coating liquid for a protective layer in Example 7, i.e., "160 parts by weight of cyclopentanol" is changed to "200 parts by weight of cyclopentyl methyl ether".

Comparative Example 7

An electrophotographic photoreceptor is prepared in the same manner as in Example 1 except that "2 parts by weight of melamine" is changed to "10 parts by weight of melamine", and the size (volume) of the liquid droplet from the nozzle is changed to 8 pl.

Thus, a photoreceptor having a content of the charge transporting material in the surface protective layer of less than 90% by weight is obtained, but the electric characteristics as the photoreceptor are deteriorated, and the dispersibility of the polytetrafluoroethylene particles are also much deteriorated.

Comparative Example 8

An electrophotographic photoreceptor is prepared in the same manner as in Example 1 except that: "70 parts by weight of the compound (I-10) and 70 parts by weight of compound (I-25)" are changed to "55 parts by weight of the compound (I-10) and 50 parts by weight of the compound (I-25)"; "200 parts by weight of cyclopetanone (as a solvent)" is changed to "150 parts by weight of cyclopetanone (as a solvent)"; "10 parts by weight of polytetrafluoroethylene particles (LUBRON L-2, trade name, manufactured by Daikin Industries Ltd.)" is changed to "2 parts by weight of polytetrafluoroethylene particles (LUBRON-L2, trade name, manufactured by Daikin Industries Ltd.)"; "0.5 parts by weight of a fluorinated comb-type graft polymer (GF300, trade name, manufactured by Toagosei Co., Ltd.)" is changed to "0.1 parts by weight of a fluorinated comb-type graft polymer (GF300, trade name, manufactured by Toagosei Co., Ltd.)"; and the size (volume) of the liquid droplet from the nozzle is changed to 8 pl.

Thus, a photoreceptor having a content of the fluorinated resin particles in the surface protective layer of less than 2% by weight is obtained.

For the photoreceptors in Examples 2 to 11 and Comparative Examples 1 to 8, measurement of [b/a] and evaluation tests are carried out by the method described in Example 1.

What is claimed is:

1. An electrophotographic photoreceptor comprising:

a substrate, a photosensitive layer, and a surface protective layer, in this order, the surface protective layer comprising a crosslinked product of a curable charge transporting material and fluorinated resin particles, a content of the charge transporting material being from about 90% by weight to about 98% by weight and a content of the fluorinated resin particles being from about 2% by weight to about 10% by weight, and the surface protective layer satisfying the following Formula (I):

$$0.5 \leq b/a \leq 0.9 \qquad \text{Formula (1)}$$

wherein, in Formula (1), "a" represents a ratio of fluorine atoms to the sum of carbon atoms, oxygen atoms, and fluorine atoms present in a region of the surface protective layer ranging from the photosensitive layer side surface of the surface protective layer to a point corresponding to about ⅔ of the film thickness of the surface protective layer, and "b" represents a ratio of fluorine atoms to the sum of carbon atoms, oxygen atoms, and fluorine atoms present in a region of the surface protective layer ranging from the outer surface of the surface protective layer to a point corresponding to about ⅓ of the film thickness of the surface protective layer.

2. The electrophotographic photoreceptor according to claim 1, wherein the surface protective layer comprises a cured film obtained by thermosetting a compound having a guanamine structure or a melamine structure, and the charge transporting material comprising at least one substituent selected from the group consisting of —OH, —$OCH_3$, —$NH_2$, —SH, and —COOH using an acid catalyst.

TABLE 1

| | | Solvent | Viscosity [mPa] | Size [pl] of liquid droplet | Coating method | a | b | b/a | Transfer efficiency [%] Initial | Transfer efficiency [%] After abrasion |
|---|---|---|---|---|---|---|---|---|---|---|
| Example | 1 | Cyclopetanone | 13 | 5 | Inkjet | 2.8 | 2.4 | 0.9 | 92 | 88 |
| | 2 | Cyclopetanone | 13 | 8 | Inkjet | 2.8 | 2.4 | 0.9 | 92 | 88 |
| | 3 | Cyclopetanone | 13 | 10 | Inkjet | 3 | 2.2 | 0.7 | 92 | 87 |
| | 4 | Cyclopetanone | 13 | 20 | Inkjet | 3.4 | 1.8 | 0.5 | 92 | 84 |
| | 5 | Cyclopetanone Cyclopentanol | 43 | 5 | Inkjet | 2.8 | 2.4 | 0.9 | 92 | 89 |
| | 6 | Cyclopetanone Cyclopentanol | 20 | 20 | Inkjet | 2.8 | 2.4 | 0.9 | 92 | 89 |
| | 7 | Isopropyl alcohol Cyclopentanol | 18 | — | Dipping | 2.6 | 2.6 | 1 | 91 | 88 |
| | 8 | Cyclopetanone | 13 | 8 | Inkjet | 2.8 | 2.4 | 0.9 | 92 | 88 |
| | 9 | Cyclopetanone | 13 | 8 | Inkjet | 0.9 | 0.8 | 0.9 | 90 | 84 |
| | 10 | Cyclopetanone | 13 | 8 | Inkjet | 0.9 | 0.8 | 0.9 | 88 | 84 |
| | 11 | Cyclopetanone | 13 | 8 | Inkjet | 3.5 | 2.9 | 0.9 | 92 | 89 |
| Comparative Example | 1 | Cyclopetanone | 13 | 30 | Inkjet | 4 | 1.2 | 0.3 | 91 | 80 |
| | 2 | Cyclopetanone | 13 | — | Dipping | 4 | 1.2 | 0.3 | 90 | 80 |
| | 3 | Isopropyl alcohol | 11 | 10 | Inkjet | 4 | 1.2 | 0.3 | 91 | 80 |
| | 4 | Cyclopentanol | 50 | 10 | Inkjet | 4 | 1.2 | 0.3 | 92 | 80 |
| | 5 | Cyclopetanone | 8 | 5 | Inkjet | 4 | 1.2 | 0.3 | 92 | 80 |
| | 6 | Isopropyl alcohol Cyclopentyl methyl ether | 13 | — | Dipping | 0.8 | 12.8 | 16 | 93 | 78 |
| | 7 | Cyclopetanone | 13 | 8 | Inkjet | 2.8 | 2.4 | 0.9 | 92 | 88 |
| | 8 | Cyclopetanone | 13 | 8 | Inkjet | 0.9 | 0.8 | 0.9 | 86 | 80 |

3. The electrophotographic photoreceptor according to claim 1, wherein the charge transporting material comprises a compound represented by the following Formula (I):

$$F—((—R^7—X)_{n1}(R^8)_{n3}—Y)_{n2} \quad \text{Formula (I)}$$

wherein, in Formula (I), F represents an organic group derived from a compound having a positive hole transporting ability; $R^7$ and $R^8$ each independently represent a linear or branched alkylene group having 1 to 5 carbon atoms; n1 represents 0 or 1; n2 represents an integer from 1 to 4; n3 represents 0 or 1; X represents an oxygen atom, NH, or a sulfur atom; and Y represents —OH, —$OCH_3$, —$NH_2$, —SH, or —COOH.

4. The electrophotographic photoreceptor according to claim 3, wherein the compound represented by Formula (I) is a compound represented by Formula (II):

(II)

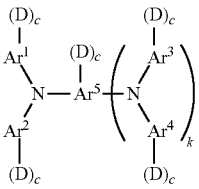

wherein, in Formula (II), $Ar^1$ to $Ar^4$ may be the same as or different from each other, and each independently represent a substituted or unsubstituted aryl group; $Ar^5$ represents a substituted or unsubstituted aryl group or a substituted or unsubstituted arylene group; D's each represent —$(—R^7—X)_{n1}(R^8)_{n3}$—Y, and plural D's may the same as or different from each other; each c independently represents 0 or 1; k represents 0 or 1; and the total number of plural D's is from 1 to 4; $R^7$ and $R^8$ each independently represent a linear or branched alkylene group having 1 to 5 carbon atoms; n1 represents 0 or 1; n3 represents 0 or 1; X represents an oxygen atom, NH or a sulfur atom; and Y represents —OH, —$OCH_3$, —$NH_2$, —SH, or —COOH.

5. An image forming apparatus comprising:

an electrophotographic photoreceptor;

a charging device that charges the electrophotographic photoreceptor;

a latent image forming device that forms an electrostatic latent image on the surface of the electrophotographic photoreceptor;

a developing device that forms a toner image by developing the electrostatic latent image formed on the surface of the electrophotographic photoreceptor using a toner; and a transfer device that transfers the toner image formed on the surface of the electrophotographic photoreceptor onto a recording medium, the electrophotographic photoreceptor comprising:

a substrate;

a photosensitive layer; and a surface protective layer, in this order, the surface protective layer comprising a crosslinked product of a curable charge transporting material and fluorinated resin particles, and a content of the charge transporting material being from about 90% by weight to about 98% by weight and a content of the fluorinated resin particles being from about 2% by weight to about 10% by weight, and the surface protective layer satisfying the following Formula (1):

$$0.5 \le b/a \le 0.9 \quad \text{Formula (1)}$$

wherein, in Formula (1), "a" represents a ratio of fluorine atoms to the sum of carbon atoms, oxygen atoms, and fluorine atoms present in a region of the surface protective layer ranging from the photosensitive layer side surface of the surface protective layer to a point corresponding to about ⅔ of the film thickness of the surface protective layer, and "b" represents a ratio of fluorine atoms to the sum of carbon atoms, oxygen atoms, and fluorine atoms present in a region of the surface protective layer ranging from the outer surface of the surface protective layer to a point corresponding to about ⅓ of the film thickness of the surface protective layer.

6. The image forming apparatus according to claim 5, wherein the charge transporting material comprises a compound represented by the following Formula (I):

$$F—((—R^7—X)_{n1}(R^8)_{n3}—Y)_{n2} \quad \text{Formula (I)}$$

wherein, in Formula (I), F represents an organic group derived from a compound having a positive hole transporting ability; $R^7$ and $R^8$ each independently represent a linear or branched alkylene group having 1 to 5 carbon atoms; n1 represents 0 or 1; n2 represents an integer from 1 to 4; n3 represents 0 or 1; X represents an oxygen atom, NH, or a sulfur atom; and Y represents —OH, —$OCH_3$, —$NH_2$, —SH, or —COOH.

7. A process cartridge comprising:

an electrophotographic photoreceptor;

a charging device that charges the electrophotographic photoreceptor;

a latent image forming device that forms an electrostatic latent image on the surface of the electrophotographic photoreceptor;

a developing device that forms a toner image by developing the electrostatic latent image formed on the surface of the electrophotographic photoreceptor using a toner;

a transfer device that transfers the toner image formed on the surface of the electrophotographic photoreceptor onto a recording medium; and a cleaning device that cleans the surface of the electrophotographic photoreceptor, the electrophotographic photoreceptor comprising:

a substrate;

a photosensitive layer; and a surface protective layer, in this order, the surface protective layer comprising a crosslinked product of a curable charge transporting material and fluorinated resin particles, and a content of the charge transporting material being from about 90% by weight to about 98% by weight and a content of the fluorinated resin particles being from about 2% by weight to about 10% by weight, and the surface protective layer satisfying the following Formula (1):

$$0.5 \le b/a \le 0.9 \quad \text{Formula (1)}$$

wherein, in Formula (1), "a" represents a ratio of fluorine atoms to the sum of carbon atoms, oxygen atoms, and fluorine atoms present in a region of the surface protective layer ranging from the photosensitive layer side surface of the surface protective layer to a point corresponding to about ⅔ of the film thickness of the surface protective layer, and "b" represents a ratio of fluorine atoms to the sum of carbon atoms, oxygen atoms, and fluorine atoms in a region of the surface protective layer ranging from the outer surface of the surface protective layer to a point corresponding to about ⅓ of the film thickness of the surface protective layer.

8. The process cartridge according to claim 7, wherein the charge transporting material comprises a compound represented by the following Formula (I):

$$F—((—R^7—X)_{n1}(R^8)_{n3}—Y)_{n2} \qquad \text{Formula (I)}$$

wherein, in Formula (I), F represents an organic group derived from a compound having a positive hole transporting ability; $R^7$ and $R^8$ each independently represent a linear or branched alkylene group having 1 to 5 carbon atoms; n1 represents 0 or 1; n2 represents an integer from 1 to 4; n3 represents 0 or 1; X represents an oxygen atom, NH, or a sulfur atom; and Y represents —OH, —$OCH_3$, —$NH_2$, —SH, or —COOH.

* * * * *